US005926154A

United States Patent [19]

Hirono et al.

[11] Patent Number: 5,926,154

[45] **Date of Patent: *Jul. 20, 1999**

[54] DOUBLE-SCREEN DISPLAY DEVICE

[75] Inventors: Itaru Hirono, Yokohama; Michihiro Miyasaka; Tsuyoshi Matsumoto, both of Kawasaki, all of Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/556,515

[22] Filed: Nov. 13, 1995

[30] Foreign Application Priority Data

Nov. 11, 1994 [JP] Japan ..... 6-277622

[51] Int. Cl.[6] ..... G09G 5/00

[52] U.S. Cl. ..... 345/5; 345/126

[58] Field of Search ..... 345/126, 121, 345/1, 5

[56] References Cited

FOREIGN PATENT DOCUMENTS 53-136434 11/1978 Japan .
58-2881 1/1983 Japan .
1131913 5/1989 Japan .
1216385 8/1989 Japan ..... 345/1
3-140995 6/1991 Japan .
5197507 8/1993 Japan .
6-34934 2/1994 Japan .

*Primary Examiner*—Regina Liang
*Attorney, Agent, or Firm*—Staas & Halsey

[57] ABSTRACT

Each of right- and left-deflection holograms is provided for a picture element in a vertical scanning line on the screen of a display unit. For example, the right- and left-deflection hologram are alternately arranged in a single vertical scanning line. A normal image is displayed through the picture elements corresponding to the right-deflection holograms while an inverted image is obtained by rotating the normal image by 180 degrees and is displayed through the picture elements corresponding to the left-deflection holograms. Thus, the two users sitting face to face with the screen of the display device between them can see the image displayed on the screen as a normal image. In addition to the images, a pair of markers are displayed on the screen. These markers are operated by a marker operating unit which moves one marker. The other marker is moved correspondingly by the same amount of movement in the 180-degree opposite direction.

79 Claims, 18 Drawing Sheets

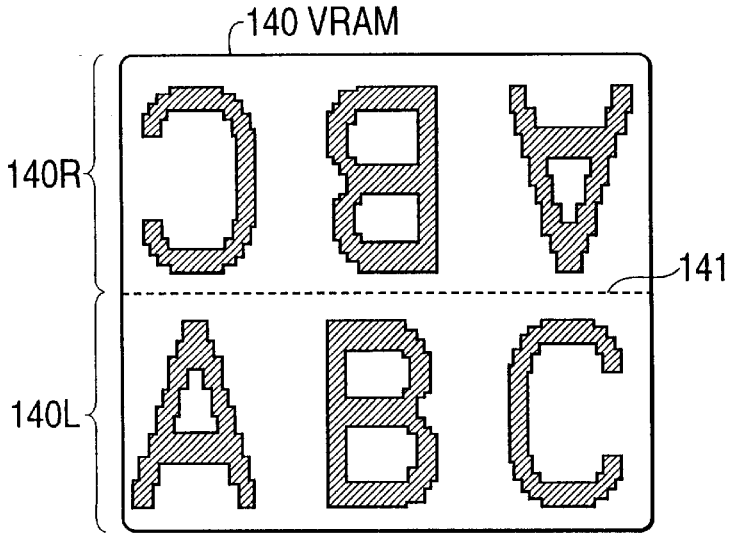
FIG. 16A
FIG. 16B
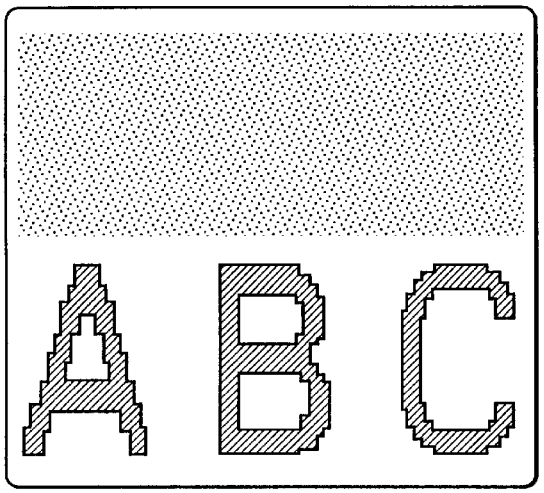
DISPLAY POSITION OF IMAGE VISIBLE BY SERVER
DISPLAY POSITION OF IMAGE VISIBLE BY CUSTOMER
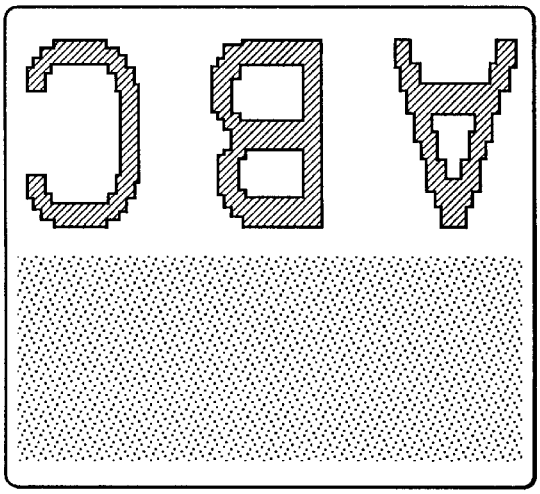
FIG. 16C

DOUBLE-SCREEN DISPLAY DEVICE

BACKGROUND OF THE INVENTION

1. Field of the Invention

The present invention relates to a display device and more specifically to a double-screen display device on which information such as images, drawings, graphs, documents, etc. are displayed when at least two persons have discussions face to face with each other by referring to the information displayed on the device.

2. Description of the Related Art

The display unit of the conventional display device has a single screen, and is normally designed to be mounted vertically. The display format of the display unit is, for example, opening a plurality of windows on a single screen to separately display images, documents, numerical characters, etc. on each window.

However, the conventional display device is designed and installed to allow only a single operator to exclusively refer to its screen and perform various processes. Some display devices are provided with display units to be mounted such that the screens can be set horizontal. Such display devices have been exclusively developed to personally play game on, but is not designed to allow a plurality of persons to simultaneously watch the screen from various directions.

Recently, personal computers (including desktop and portable computers) and workstations are popularly used in conferences to replace the printed materials distributed to attendants of conferences or the overhead projectors (OHP). To support this tendency, various presentation tools have been introduced by utilizing large capacity storage media in electronic, optical, electromagnetic, and combination of these storage methods.

With these presentation tools, the large capacity storage media store document and image data so that various information can be effectively displayed by switching and simultaneously displaying the data on the screen by the screen switching, screen segmenting, and multiple window methods on the screen of, for example, the cathode ray tube (CRT) display, liquid-crystal display, plasma display, projector, etc.

The information material to be used in explaining a given subject in a conference can be actually generated by such presentation tools, but is displayed on the conventional vertically-fit display screens. Common projectors can satisfactorily work in, for example, a lecture meeting where a large number of attendants simultaneously watch the same material displayed on the screen. However, if the projector is used in a conference room by a small number of attendants, the attendants have to rush shoulder to shoulder in front of the small screen of a projector, and some attendants cannot watch the screen at all. With such a layout of the seats of the attendants, they cannot concentrate on the explanation and discussion because they sit too close to one another to watch the display.

When a number of attendants have a meeting and discussions, it is desired that they sit face to face with a table between them. Accordingly, the conventional display devices cannot be used to solve the problem.

Normally, customers access the counters and windows of financial organizations, tourist bureaus, official organizations, government offices, various festivals and meetings, ticket boxes, etc. In such cases, the vertically-fit display can be fit horizontally. However, the customer and the server watch the information material in the opposite directions to each other. Therefore, one can watch the material in the right direction, but the other has to watch it upside down. If the material is text data, the other person has difficulty in reading the text.

To solve the above described problems, Tokukaisho 53-136434, Tokukaisho 58-002881, and Tokukaihei 03-140995 are laid open by the Japanese Patent Office to public inspection.

Tokukaisho 53-136434 disclosed in the official publication discloses the technology of displaying an image on both sides of the screen. The image is displayed double as inverted on the left and right windows on each screen so that the same image can be viewed by the customer and the server. Tokukaisho 58-002881 and Tokukaihei 03-140995 disclose the technology of providing image memory for each screen, writing images opposite to each other (an original image and its 180-degree-rotated image), and displaying the two images by switching them when necessary so that the two persons can view the same normal image on each seat.

However, the screen of Tokukaisho 53-136434 according to the official publication disturbs the communications between the two persons. Tokukaisho 58-002881 and Tokukaihei 03-140995 have the problem that the images viewed by the two persons are inverted to each other and need switching into the 180-degree-inverted image when explanation is given from one to the other. If the image is symmetrically rotated by 180 degrees each time the explanation is given, the two persons have to recognize the images each time they are switched, thereby preventing them from concentrating on the explanation itself.

Therefore, instead of displaying the material on the display screen, the photographic material such as catalogs is used with explanatory text and price lists. However, they are separate pamphlets and rather heavy when sales persons carry them to visit their customers. They also occupy large space on the table and makes a messy table.

SUMMARY OF THE INVENTION

The present invention aims at providing a double-screen device useful to the users when they sit face to face and with the double-screen device placed between them and view the same image displayed on the screen of the double-screen device.

Another object of the present invention is to display a marker on the screen of the display unit to point to an object point of the displayed image.

A further object of the present invention is to display attribute information about the material displayed on the screen of the double-screen device and to allow the information to be viewed by only one of the users.

To realize the above described objects, the double-screen device comprises a displaying memory, for example, a video RAM, for storing an image; a display unit for displaying the image stored in the displaying memory; an image writing unit for writing to the displaying memory a first image and a second image symmetrical to the first image about the central point of the entire screen; and a view direction control unit for controlling the view direction of each picture element forming part of the screen of the display unit, and controlling the view direction of the first image and second image.

The view direction control unit comprises, for example, a first blocking unit for controlling the radiating direction of the light from each picture element forming part of the screen of the display unit and for making, through complex deflection control, etc., the light invisible from the first view field; and a second blocking unit for making the light invisible from the second view field.

The first view field and second view field are located opposite to each other on the screen of the display unit.

The first blocking unit and second blocking unit are provided for each picture element.

The blocking units are, for example, holograms. When the holograms are used as blocking units, the adjacent holograms are separated by a light blocking unit.

With this configuration, the double-screen device further comprises a first marker move instructing unit for instructing to move the first marker displayed on the screen of the display unit; a second marker move instructing unit for instructing to move the second marker displayed on the screen of the display unit; and a marker move control unit for modifying, at an instruction from one of the first marker move instructing unit and second marker move instructing unit, the write position of the image of the first or second marker in the image memory so that the other marker also moves on the screen of the display unit.

Another double-screen device according to the present invention comprises a displaying memory for storing an image; a display unit for displaying the image stored in the displaying memory; a first image memory for storing an entire first image; a second image memory for storing an entire second image symmetric to the first image about the central point of the entire screen; an image writing unit for writing a part of the first image stored in the first image memory and the second image stored in the second image memory to exclusive positions in the displaying memory so that the image displayed on the display unit can be written to the displaying memory; and a view direction control unit for controlling the view direction of each picture element forming part of the screen of the display unit, and controlling the view direction of the first image and second image.

With the configuration, the double-screen device can, preferably, further comprise an image storage control unit for writing only an image read by the image writing unit to the first image memory or second image memory.

A further double-screen device according to the present invention comprises a displaying memory for storing an image; a display unit for displaying the image stored in the displaying memory; an image writing unit for writing a plurality of images to the displaying memory; and a view direction control unit for controlling the view direction of each picture element forming part of the screen of the display unit, and controlling the view directions of the plurality of images.

With this configuration, the double-screen device, preferably, further comprises a first marker move instructing unit for instructing to move the first marker displayed on the screen of the display unit; a second marker move instructing unit for instructing to move the second marker displayed on the screen of the display unit; and a marker move control unit for modifying, at an instruction from one of the first marker move instructing unit and second marker move instructing unit, the write position of the image of the first or second marker in the displaying memory so that the other marker also moves on the screen of the display unit.

A further double-screen device according to the present invention comprises a displaying memory for storing an image; a display unit for displaying the image stored in the displaying memory; N image memories for storing different N images; an image writing unit for writing a part of N images stored in the N image memories to exclusive positions in the displaying memory so that an image displayed on the display unit can be written to the displaying memory; and a view direction control unit for controlling a view direction of each picture element forming part of the screen of the display unit, and controlling the view direction of the N images. The double-screen device can be designed to further comprise a control unit for writing only an image read by the image writing unit to at least one of the N image memories.

A further double-screen device according to the present invention comprises a displaying memory for storing an image; a display unit for displaying the image stored in the displaying memory; an image writing unit for alternately writing a plurality of images to the displaying memory; and a view direction control unit for controlling a view direction of each picture element forming part of the screen of the display unit, and controlling the view directions of the plurality of images alternately displayed on the screen such that the view direction of one image is opposite to the view direction of the other.

With the configuration, the double-screen device, preferably, further comprises a first marker move instructing unit for instructing to move the first marker displayed on the screen of the display unit; a second markers move instructing unit for instructing to move the second marker displayed on the screen of the display unit; and a marker move control unit for modifying, at an instruction from one of the first marker move instructing unit and second marker move instructing unit, the write position of the image of the first or second marker in the displaying memory so that the other marker also moves on the screen of the display unit.

The view direction control unit comprises, for example, a blocking unit for controlling the radiating direction of the light from each picture element forming part of the screen of the display unit and for making, through complex deflection control, etc., the light invisible from the first view field and for making the light invisible from the second view field. The blocking unit can be liquid-crystal.

A further double-screen device according to the present invention comprises a displaying memory for storing an image; a display unit for displaying the image stored in the displaying memory; an image writing unit for writing to the displaying memory a first image, a second image symmetrical to the first image about a central point of an entire screen, and information about the first image; and a view direction control unit for controlling a view direction of each picture element forming part of the screen of the display unit, controlling the view directions of the first image and second image displayed on the screen, and controlling the view direction of the information about the first image such that the information can be displayed in the same view direction of the first image.

The information about the first image is, for example, text data.

A further double-screen device according to the present invention comprises a storage device storing a removable storage medium containing an image file; a displaying memory for storing an image; a display unit for displaying the image stored in the displaying unit; an image writing unit for reading a first image stored in the image file and writing to the displaying memory the first image and a second image symmetrical to the first image about the central point of the entire screen; and a view direction control unit for controlling a view direction of each picture element forming part of the screen of the display unit, and controlling the view direction of the first image and second image.

A further double-screen device according to the present invention comprises a storage device storing a removable storage medium containing an image file; a displaying memory for storing an image; a display unit for displaying the image stored in the displaying memory; a first image memory for storing an entire first image; a second image memory for storing an entire second image symmetric to the first image about the central point of the entire screen; a first image writing unit for reading the first image from the image file, writing the first image to the first image memory, generating the second image from the first image, and writing the second image to the second image memory; a second image writing unit for writing a part of the first image stored in the first image memory and the second image stored in the second image memory to exclusive positions in the displaying memory so that an image displayed on the display unit can be written to the displaying memory; and a view direction control unit for controlling a view direction of each picture element forming part of the screen of the display unit, and controlling the view direction of the first image and second image.

A further double-screen device according to the present invention comprises a storage device storing a removable storage medium containing an image file; a displaying memory for storing an image; a display unit for displaying the image stored in the displaying memory; an image writing unit for reading a first image stored in the image file and writing to the displaying memory the first image and a second image symmetrical to the first image about the central point of the entire screen; a view direction control unit for controlling a view direction of each picture element forming part of the screen of the display unit, and controlling the view direction of the first image and second image; a first marker move instructing unit for instructing to move the first marker displayed on the screen of the display unit; a second marker move instructing unit for instructing to move the second marker displayed on the screen of the display unit; and a marker move control unit for modifying, at an instruction from one of the first marker move instructing unit and second marker move instructing unit, the write position of the image of the first or second marker in the displaying memory so that the other marker also moves on the screen of the display unit.

A further double-screen device according to the present invention comprises a storage device storing a removable storage medium containing an image file; a displaying memory for storing an image; a display unit for displaying the image stored in the displaying memory; an image writing unit for reading a first image, generating a second image symmetrical to the first image about the central point of the entire screen, and alternately writing to the displaying memory the first image and second image; a view direction control unit for controlling a view direction of each picture element forming part of the screen of the display unit, and controlling the view directions of the first image and second image alternately displayed on the screen such that the view direction of the first image is opposite to the view direction of the second image; a first marker move instructing unit for instructing to move a first marker displayed on the screen of the display unit; a second marker move instructing unit for instructing to move a second marker displayed on the screen of the display unit; and a marker move control unit for modifying, at an instruction from one of the first marker move instructing unit and second marker move instructing unit, a write position of the image of the first or second marker in the displaying memory so that the other marker also moves on the screen of the display unit.

With the configuration, the display unit of the double-screen device can be a desktop unit, and can be applied as display unit of a handy terminal device.

BRIEF DESCRIPTION OF THE DRAWINGS

FIGS. 16A through 16C shows a variation of the display of an image according to the present invention;

FIG. 16A shows the contents of the image data written to the VRAM;

FIG. 16B shows an image viewed by the server;

FIG. 16C shows an image viewed by the customer;

DESCRIPTION OF THE PREFERRED EMBODIMENTS

Figure 1A:
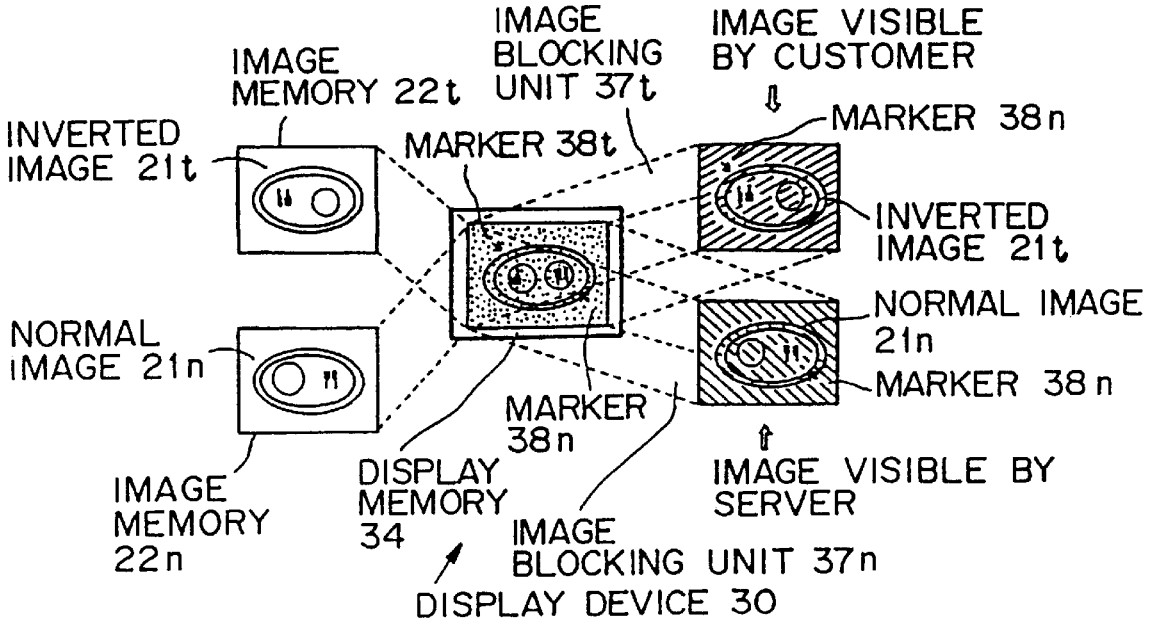
FIG. 1A shows the principle of the method of displaying an image on the display device according to the present invention.
Figure 1B:
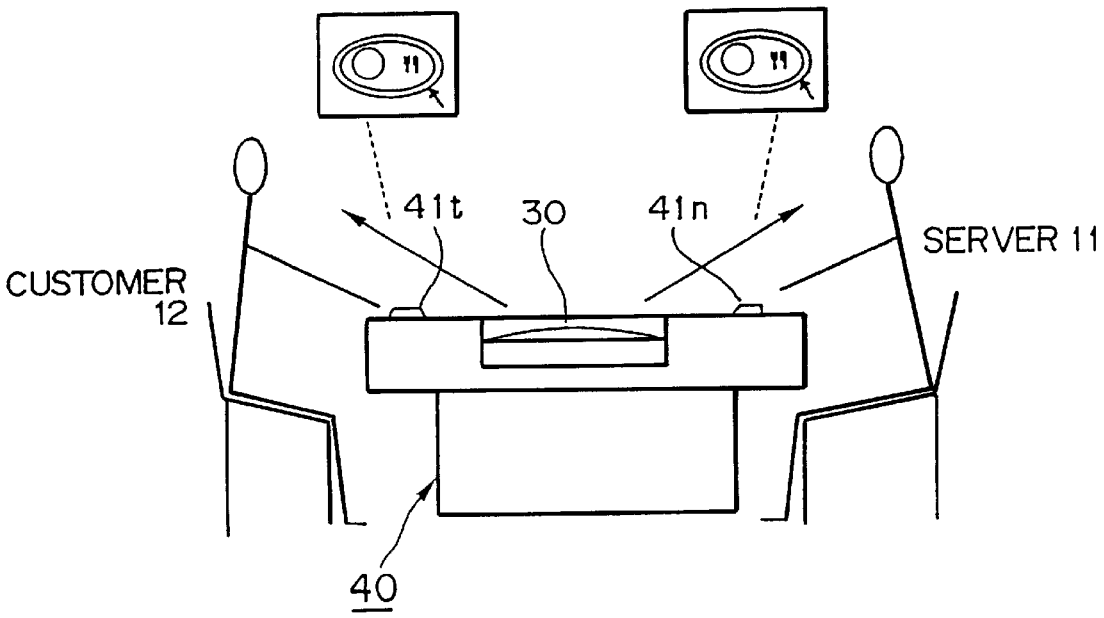
FIG. 1B shows the images visible by the server and customer sitting face to face with the display device according to the present invention.

FIGS. 1A and 1B show the method of displaying data according to the present embodiment.

According to the present embodiment, a customer 12 and a server 11 communicates face to face with each other as shown in FIG. 1B.

FIG. 1A shows the method of displaying the image on a display device 30 shown in FIG. 1B.

Image memory 22*n* and 22*t* and a display memory 34 are incorporated into the display device 30.

A first image memory 22*n* stores a first image (normal image) 21*n* viewed by the server 11. A second image memory 22*t* stores a second image (inverted image) 21*t* obtained by rotating the normal image 21*n* viewed by the customer 12 by 180 degrees centering on the center point of the normal image 21*n*. That is, the normal image 21*n* and inverted image 21*t* are located symmetrically about the central point. Each of the normal image 21*n* and the inverted image 21*t* is a set of a plurality of picture elements.

A display memory 34 stores picture elements of an image displayed on the display device 30, and comprises, for example, a video RAM (VRAM). The display memory 34 stores in a picture element unit the data of picture elements forming the image displayed on screen of the display device 30. On the screen of the display device 30, a first blocking unit 38*n* or a second blocking unit 38*t* is selectively provided for each picture element displayed on the screen.

The first blocking unit 38*n* allows the server 11 to view only first picture elements, of all picture elements forming the image written to the display memory 34, to be visible by the server 11, and blocks the first picture elements from the view of the customer 12.

The second blocking unit 38*t* oppositely functions to the first blocking unit 38*n*. That is, it allows the customer 12 to view only second picture elements, of all picture elements forming the image written to the display memory 34, to be visible by the customer 12, and blocks the second picture elements from the vi of the server 11.

The first and second images 21*t* and 21*n* stored in the image memory 22*t* and image memory 22*n* are read in a picture element unit and written to the positions of the picture elements in the display memory 34. At this time, the picture elements of a first image (normal image) 31*n* are written to the positions of the picture elements in the display memory 34 corresponding to the distribution positions of the first blocking unit 37*n*. The picture elements of a second image (inverted image) 31*t* are written to the positions of the picture elements in the display memory 34 corresponding to the distribution positions of the second blocking unit 37*t*.

Thus, the server 11 can view only the normal image 21*n* of the normal images 21*n* and the inverted images 21*t* written to the display memory 34 through the operation of the first blocking unit 37*n*. The customer 12 views the image memory 22*t* as it is through the operation of the second blocking unit 37*t*. Since the customer 12 sits at the position where the inverted image 21*t* can be viewed as a normal image, the customer 12 can also view the inverted image 21*t* as a normal image. That is, both the server 11 and customer 12 can see the image as a normal image.

As shown in FIG. 1B, a first marker operating unit 41*n* for the server 11 and a second marker operating unit 41*t* for the customer 12 are provided on a stand 40 at which both server 11 and customer 12 sit face to face. These first marker operating unit 41*n* and second marker operating unit 41*t* are installed to move the marker 38*n* for the server 11 and the marker 38*t* for the customer 12 displayed on the display device 30. That is, if the server 11 operates the first marker operating unit 41*n*, the marker 38*n* for the server 11 moves on the display device 30 depending on the direction and amount of the movement and simultaneously the marker 38*t* for the customer 12 moves in the same way. At this time, the marker 38*t* for the customer 12 moves in the opposite direction of the marker 38*n* for the server 11.

Likewise, if the customer 12 operates the second marker operating unit 41*t*, the marker 38*t* for the customer 12 moves on the display device 30 depending on the direction and amount of the movement and simultaneously the marker 38*n* for the server 11 moves in the same way. At this time, the marker 38*n* for the server 11 moves in the opposite direction of the marker 38*t* for the customer 12.

That is, if the server 11 or customer 12 operates the first marker operating unit 41*n* or the second marker operating unit 41*t*, the operation moves not only the operator's own marker but also the other's marker.

The screen of the display device 30 is normally operated by raster scanning. Therefore, the first blocking unit 37*n* for the server 11 and the second blocking unit 37*t* for the customer 12 can be provided based on the position of the vertical scanning line of the raster scanning of the display device 30. In this case, the first blocking unit 37*n* and the second blocking unit 37*t* can be alternately provided for each vertical scanning line. They can also be alternately provided for each adjacent group of a plurality of vertical scanning lines. The picture elements of the normal image 21*n* read from the image memory 22*n* are written to the display memory 34 at the address corresponding to the vertical scanning line assigned the first blocking unit 38*n* on the screen of the display device 100. The picture elements of the normal image 21*t* read from the image memory 22*t* are written to the display memory 34 at the address corresponding to the vertical scanning line assigned the second blocking unit 37*t* on the screen of the display device 100.

When the first blocking units 37*n* and second blocking units 37*t* are alternately provided for each or a plurality of vertical scanning lines, the normal image 21*n* visible by the server 11 and the inverted image 21*t* visible by the customer 12 are visible for every predetermined number of vertical scanning lines. Therefore, the precision of the images visible by the server 11 and customer 12 depends on the resolution of the display device 30 or the number the lines of the first blocking unit 37*n* and second blocking unit 37*t* which are alternately arranged corresponding to the vertical scanning lines. That is, the precision of the images visible by the server 11 and customer 12 can be adjusted depending on the resolution of the display device 30 or the number of the lines of the first blocking unit 37*n* and second blocking unit 37*t* which are alternately arranged corresponding to the vertical scanning lines.

The first blocking unit 37*n* and the second blocking unit 37*t* can be provided for each block of a plurality of adjacent picture elements, each block forming part of the screen of the display device 30. In this case, the picture elements of the normal image 21*n* for the server 11 read from the image memory 22*n* are written at the address of the display memory 34 corresponding to the position of the block provided with the first blocking unit 37*n*. The picture elements of the inverted image 21*t* for the customer 12 read from the image memory 22*t* are written at the address of the display memory 34 corresponding to the position of the block provided with the second blocking unit 37*t*.

In this case, the images viewed by the server 11 and customer 12 are designed in a check pattern, and the precision of the images depends on the resolution of the screen of the display device 30 or the number of picture elements of blocks. Therefore, the precision can be adjusted depending of the resolution of the screen of the display device 30 or the number of picture elements of blocks.

The display memory 34 stores the normal image 21*n* for the server 11 and the inverted image 21*t* for the customer 12. Therefore, the size of the normal image 21*n* stored in the image memory 22*n* and the inverted image 21*t* stored in the image memory 22*t* is the same as that of the display memory 34, the images stored in the image memory 22*n* and image memory 22*t* are stored in the display memory 34 as appropriately omitted. That is, the addresses of the picture elements from the image memory 22*n* and image memory 22*t* are exclusive. Therefore, the storage capacity is wasted in the image memory 22*n* and image memory 22*t*. To save the storage capacity of the image memory 22*n* and image memory 22*t*, only the picture elements written to the display memory 34 should be written to either the image memory 22*n* or the image memory 22*t*. Thus, the total storage capacity of the image memory 22*n* and image memory 22*t* can be successfully saved.

Otherwise, the positions of the marker 38*n* and marker 38*t* should correspond to the positions of the first blocking unit 37*n* and second blocking unit 37*t* respectively. Thus, The first blocking unit 37*n* makes the marker 38*n* for the server 11 invisible by the customer 12. Similarly, the second blocking unit 37*t* makes the marker 38*t* for the customer 12 invisible by the server 11 and only visible by the customer 12.

Furthermore, the normal image 21*n*, visible by the server 11 and stored in the image memory 22*n*, and the inverted image 21*t*, visible by the customer 12 and stored in the image memory 22*t*, can be alternately written to the display memory 34 at a predetermined timing.

In this case, a blocking unit is provided such that the normal image 21*n* can be invisible by the customer 12 but visible by the server 11 if the normal image 21*n* written to the display memory 34 is displayed on the screen of the display device 30, and that the inverted image 21*t* can be invisible by the server 11 but visible by the customer 12 if the inverted image 21*t* written to the display memory 34 is displayed on the screen of the display device 30.

The blocking control unit switches the images to be blocked in synchronism with the write of the images (normal image 21*n* and inverted image 21*t*) to the display memory 34. The switching cycle should be determined in the range where the images can be displayed without flicker on the display device 30. With this configuration, both server 11 and customer 12 can view the image as a normal image on the screen of the display device 30.

With the above described configuration, when the server 11 operates the first marker operating unit 41*n*, the marker 38*n* for the server 11 moves on the screen of the display device 30 corresponding to the operation of the first marker operating unit 41*n*. Similarly, when the customer 12 operates the second marker operating unit 41*t*, the marker 38*t* for the customer 12 moves on the screen of the display device 30 corresponding to the operation of the second marker operating unit 41*t*. The image data of the marker 38*n* is moved in the display memory 34 corresponding to the operation of the first marker operating unit 41*n* of the server 11. The image data of the marker 38*t* is moved in the display memory 34 corresponding to the operation of the second marker operating unit 41*t* of the customer 12.

The write control of the image data of the marker 38*n* for the server 11 and the write control of the image data of the marker 38*t* for the customer 12 are performed in synchronism with the write of the normal image 21*n* and inverted image 21*t* to the display memory 34. Therefore, the marker 38*n* for the server 11 and marker 38*t* for the customer 12 are alternately displayed in a selective manner.

A touch sensor can be provided for the first marker operating unit 41*n* or second marker operating unit 41*t*. If the touch sensor is provided for the second marker operating unit 41*t*, the customer 12 can easily access and operate the marker 38*t* without reluctance even if he or she is a beginner.

The image displayed on the screen of the display device 30 can be generated as the material used in a sales meeting. The image data is read from the data file stored on predetermined storage media. The information about the image data is stored in the data file. When the image data is read, the related information is also read. The information is written only to the image memory 22*n* for the server 11. Therefore, the information is invisible by the customer 12. Thus, if the information is effective for the server 11 but the server 11 would not like to share the information with the customer 12, the information can be controlled to be visible only by the server 11 on the screen of the display device 30.

If the display device 30 can be designed as a double-screen desktop system to be mounted onto a table and counter, then the server 11 and customer 12 can communicate with each other face to face with the desktop display device 30 between them.

If the display device 30 can be designed as a display device of a handy terminal unit, then it brings a great convenience to a sales person who can visit his customer and have a sales meeting without carrying with him the conventional heavy and massive catalogues. Additionally, in communications with the customer 12, the server 11 can explain the object items by displaying them on the screen of the display device 30 and show the desired goods selectively from a large variety of merchandise samples to the customer 12.

The above described embodiment is explained below in detail.

A hologram is used as a blocking material in the following embodiment.

FIGS. 2A through 2D show the operations of the hologram.

In FIGS. 2A through 2D, a hologram 71HR deflects light rightward, and a hologram 71HL deflects it leftward. The holograms 71HR and 71HL are applied to the reverse side of a base 72. Light enters from below the reverse side of the base 72. The base 72 comprises, for example, a glass plate, a polyethylene terephthalate (PET) film, etc. The base 72 is used as the screen of the display device 30. If the display device 30 is a liquid-crystal display device or a plasma display device, a reflection-preventive film, etc. is formed on the surface of the base 72.

Figure 2A:
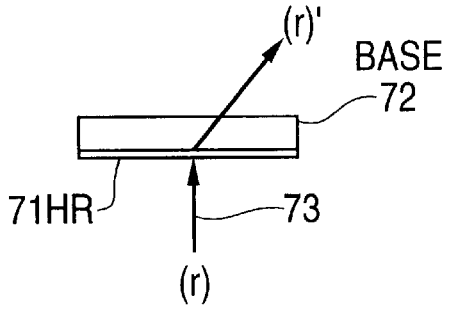
FIG. 2A shows the radiating direction of the light vertically entering the right-deflection hologram according to the first embodiment.

As shown in FIG. 2A, a light 73 enters vertically to the hologram 71HR and is deflected rightward by the hologram 71HR in the (r)' direction.

Figure 2B:
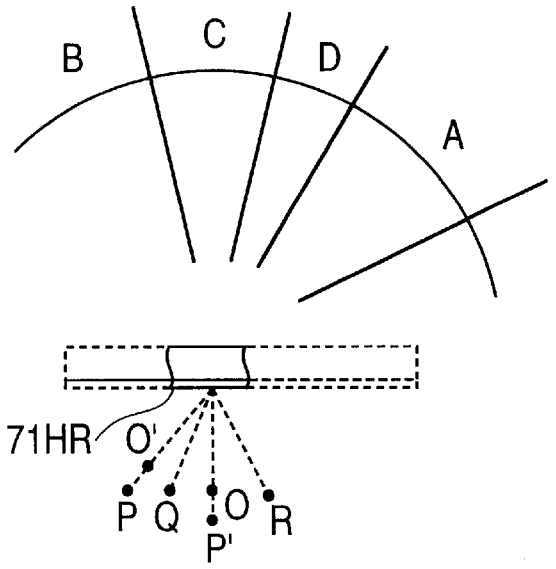
FIG. 2B shows the deflection characteristics of the right-deflection hologram.

FIG. 2B shows the view of the image at the points P, Q, O, and R when the hologram 71HR is observed from the ranges A, B, C, and D.

If the viewer watches the hologram 71HR from the range A, the light of the image at the point O entering vertically into the hologram 71HR is deflected by the hologram 71HR and reaches the vision of the viewer. Accordingly, the image at the point O is viewed as if it were located at the point O' shown in FIG. 2B. That is, the viewer sees an virtual image O', not a real image O.

If the viewer watches the hologram 71HR from the range D, the light of the image at the point Q, which is not affected by the deflection through the hologram 71HR, reaches the vision of the viewer. That is, the viewer sees a real image Q. If the viewer watches the hologram 71HR from the range C, the light of the image at the point P is deflected by the hologram 71HR and reaches the vision of the viewer. Thus, the viewer sees an virtual image P' shown in FIG. 2B. If the viewer watches the hologram 71HR from the range B, the light of the image at the point R, which is not affected by the deflection through the hologram 71HR, reaches the vision of the viewer. That is, the viewer sees a real image R.

According to the present embodiment, the hologram 71HL as well as the hologram 71HR is used. The hologram 71HL has the function of deflecting light leftward. That is, it deflects leftward the light which has vertically entered.

Figure 2C:
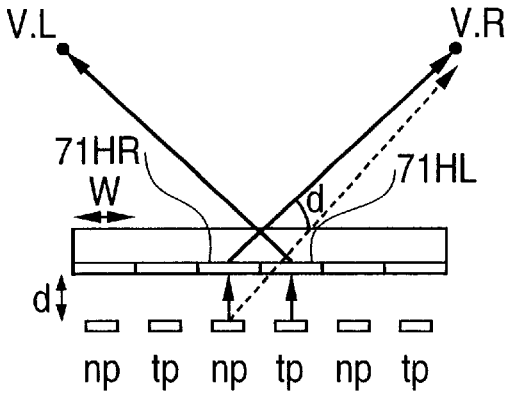
FIG. 2C shows the arrangements of the picture elements relative to the right- and left-deflection holograms.

FIG. 2C shows the configuration of each picture element on the screen, and the hologram 71HR and hologram 71HL. The picture element np shown in FIG. 2C refers to the picture element forming part of the image visible by the server 11. The picture element tp shown in FIG. 2C refers to the picture element forming part of the image visible by the customer 12.

The holograms 71HR and 71HL are located corresponding to the picture elements np and tp respectively. That is, the picture elements np and tp are alternately positioned on the screen, and each of the picture elements np and tp is assigned the holograms 71HR and 71HL respectively.

The picture elements np can be viewed if the hologram 71HR is viewed from the point V.R shown in FIG. 2C with the above described configuration. This corresponds to viewing the image O from the range A as shown in FIG. 2B. If the deflection angle of the hologram 71HR is a, the width of each of the holograms 71HR and 71HL is w, and the clearance between each of the holograms 71HR and 71HL and each of the picture elements np and tp respectively is d, and if these three variables are represented by the equation $\tan \alpha = d/w$, then the picture element np is viewed as indicated by the arrow of broken line as shown in FIG. 2C when the viewer observes the hologram 71HL from the point V.R. This corresponds to viewing the image R from the range B as shown in FIG. 2B. If the light vertically enters from the picture element tp adjacent to the right of the picture element np to the hologram 71HL, it is deflected leftward by the hologram 71HL. Therefore, the picture element tp cannot be viewed from the point V.R.

Thus, the viewer at the point V.R can see only the picture element np. Similarly, the viewer at the point V.L can see only the picture element tp.

However, if the sight of viewer goes above the position of the V.R and reaches the range D shown in FIG. 2B, then the light from the picture element tp is not affected by the deflection through the hologram 71HR and reaches the vision of the viewer through the hologram 71HR. Likewise, if the sight of the viewer goes above the position of the V.L, then the light from the picture element tp is not affected by the deflection through the hologram 71HR and reaches the vision of the viewer through the hologram 71HR.

Figure 2D:
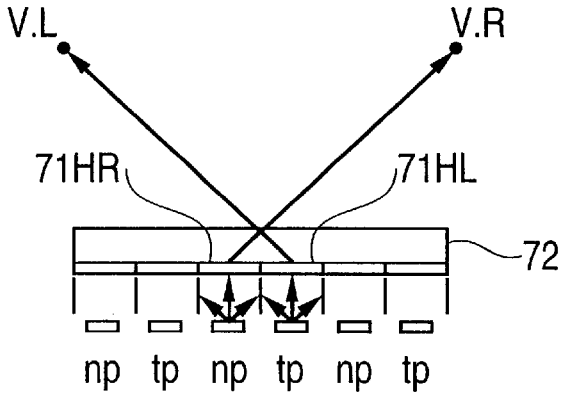
FIG. 2D shows the actual configuration of the display device according to the embodiment in which a light blocking unit is provided between the right- and left-deflection holograms.

Thus, the holograms 71HR and 71HL cannot function as blocking units. Therefore, a light blocking material 73 is provided to separate the picture element np from the picture element tp at the clearance between the holograms 71HR and 71HL and the picture elements np and tp as shown in FIG. 2D according to the present embodiment. Using the light blocking material 73, the light from the picture element np is received only by the hologram 71HR while the light from the picture element tp is received only by the hologram 71HL. The holograms 71HR and 71HL are provided on, for example, the screen of the display device.

Figure 3:
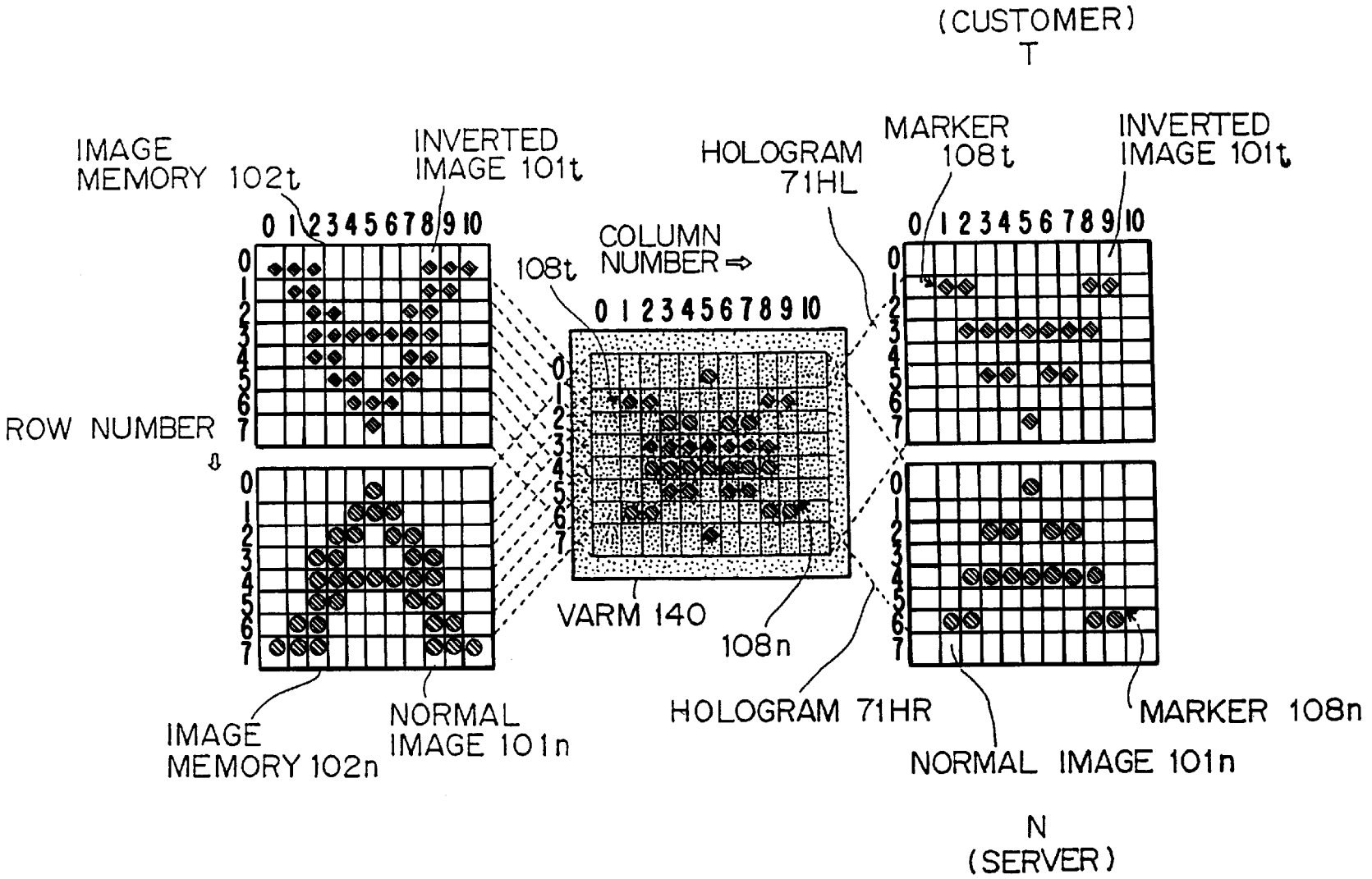
FIG. 3 shows the method of displaying images in vertical scanning line units on the display device with the configuration shown in FIG. 2D.

FIG. 3 shows the method of displaying the image according to the embodiment in which the two types of holograms 71HR and 71HL are alternately arranged in the vertical scanning lines of the raster scan on the screen of the display device.

FIG. 3 shows on the left an image memory 102*n* for the server 11 and an image memory 102*t* for the customer 12. These image memories 102*n* and 102*t* are bit map memories, and the serial numbers 0 through 7 written vertically on the left are the line numbers assigned to the vertical scanning line. The serial numbers 0 through 10 written horizontally are assigned in order of scanning in the horizontal scanning direction.

The image memory 102*n* stores a normal image 101*n* of the image data of the letter A in the dot pattern. The image memory 102*t* stores an inverted image 101*t* of the image data of the letter A in the dot pattern. In the image memory 102*n*, the displayed picture elements are indicated by ●. In the image memory 102*t*, the displayed picture elements are indicated by ◆.

A VRAM (video RAM) 140 shown at the center in FIG. 3 stores an image displayed on the screen of the display device. The picture elements stored in lines of even numbers (0, 2, 4, and 6) of the image memory 102*n* are written to the VRAM 140 at the storage positions in lines of even numbers (0, 2, 4, and 6) while the picture elements stored in lines of odd numbers (1, 3, 5, and 7) of the image memory 102*t* are written to the VRAM 140 at the storage positions in lines of odd numbers (1, 3, 5, and 7). FIG. 3 shows the picture elements of the normal image 101*n* stored in the image memory 102*n* and the picture elements of the inverted image 101*t* stored in the image memory 102*t*. The VRAM 140 stores a marker 108*n* for the server and a marker 108*t* for the customer written at the storage positions in line 1 of an odd number and line 6 of an even number.

Of the picture elements stored in the VRAM 140 shown in FIG. 3, the picture elements of the normal image 101*n* and marker 108*n* are deflected by the hologram 71HR, and the viewer sitting at the lower position shown in FIG. 3 to the VRAM 140 views the image as shown at the lower portion on the right in FIG. 3. On the other hand, the picture elements of the inverted image 101*t* and marker 108*t* are deflected by the hologram 71HL, and the viewer sitting at the upper position shown in FIG. 3 to the VRAM 140 views the image as shown at the upper portion on the right in FIG. 3. Thus, both viewers sitting face to face with the display device between them can see normal images.

Figure 4:
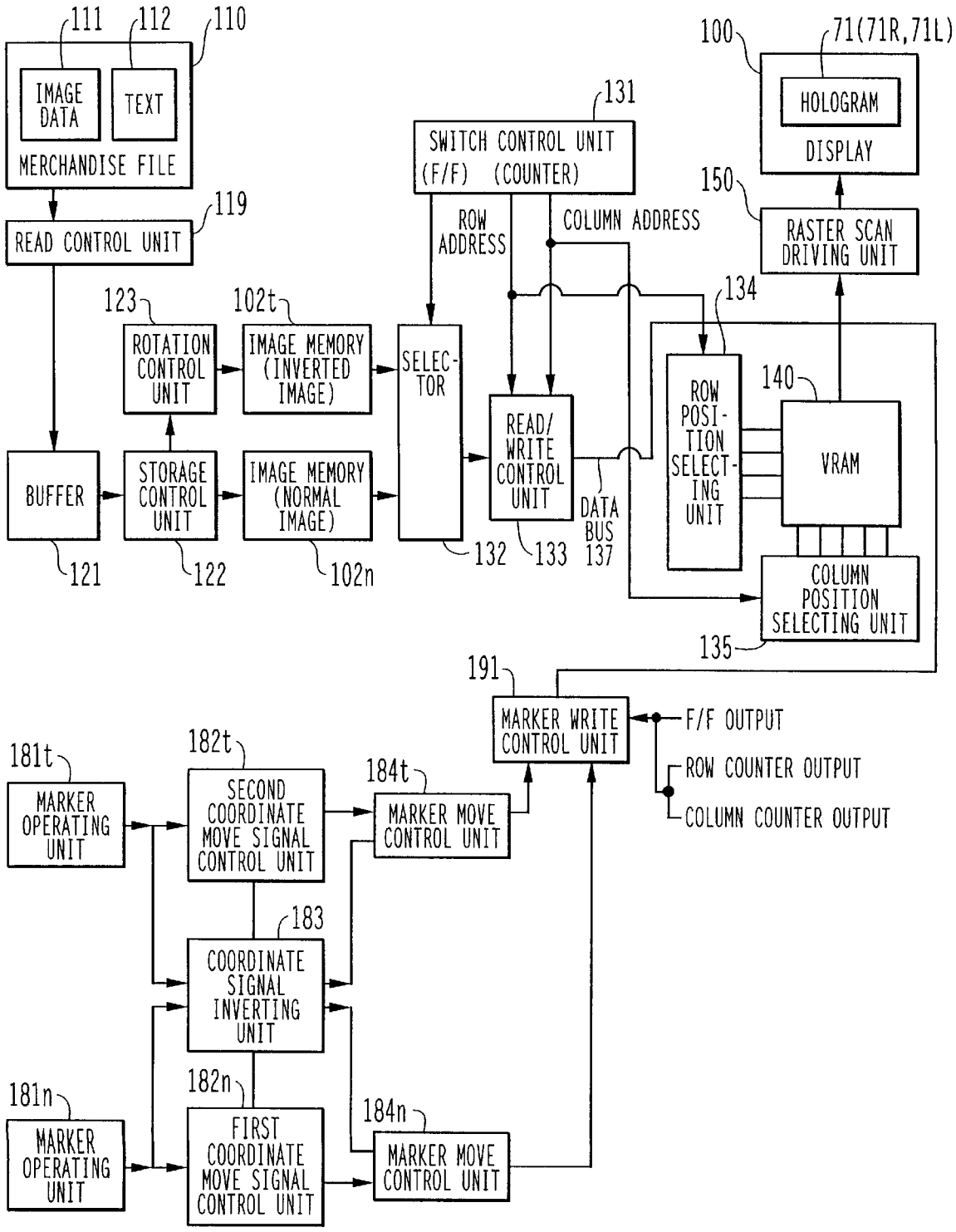
FIG. 4 is a block diagram showing the configuration of the system according to the first embodiment of the present invention.

FIG. 4 is a block diagram showing the circuit of the display device which realizes the display shown in FIG. 3.

FIG. 2D shows the configuration of the screen of a display 100. That is, the screen is provided with the holograms 71HR and 71HL corresponding to each of the picture elements np and tp respectively, and each of the picture elements np and tp is separated by the blocking material 73. The hologram 71HR is provided corresponding to the picture element np provided for the scanning line of an even number of the raster scan on the screen of the display 100. The hologram 71HL is provided corresponding to the picture element tp provided for the scanning line of an odd number of the raster scan on the screen of the display 100. The position on the screen of the display 100 is specified by the normal XY coordinate system. The X axis corresponds to the horizontal direction and the Y axis corresponds to the vertical scanning direction.

A merchandise file 110 is a file stored in a cartridge-type storage medium such as CD-ROM, and can be a hybrid file storing two types of data in individual formats, that is, image data 111 such as printed matters, photographs, drawings, etc. and text data 112 comprising document information relating to the image data 111.

A read control unit 119 reads the image data 111 and text data 112 from the merchandise file 110 and writes the data to a buffer 121 after adding to the data a type flag indicating image or text.

The buffer 121 stores, for example, one line of the image data 111 and the text data 112 to be displayed on the display 100.

A storage control unit 122 reads the image data 111 from the buffer 121, stores it in an image memory 102*n* in picture element unit, and transfers it to a rotation control unit 123. The storage control unit 122 also reads the text data 112 from the buffer 121 and stores it in the image memory 102*n* after developing it into a dot pattern.

The rotation control unit 123 rotates by 180 degrees the image data 111 transferred from the storage control unit 122 and writes it to an image memory 102*t*. Thus, an inverted image of the image data 111 stored in the image memory 102*t* is written to the image memory 102*t*.

A switch control unit 131 controls the operations of a selector 132, a read/write control unit 133, a row position selecting unit 134, and a column position selecting unit 135.

The selector 132 switches in vertical scanning line units the image data of the normal image 101*n* stored in the image memory 102*n* and the inverted image 101*t* stored in the image memory 102*t* according to the selection signal received from the switch control unit 131, and then outputs them to the read/write control unit 133.

The read/write control unit 133 writes the picture elements of the normal image 101*n* and inverted image 101*t* received from the selector 132 at the addresses corresponding to the VRAM 140 through a data bus 137 according to the row address and column address entered from the switch control unit 131. The address is determined by the row address and the column address.

The row position selecting unit 134 latches the row address received from the switch control unit 131 and outputs it as a row address signal to the VRAM 140.

The column position selecting unit 135 latches the column address received from the switch control unit 131 and outputs it as a column address signal to the VRAM 140.

The switch control unit 131 outputs the row address and column address to a row position selecting unit 304 and the column position selecting unit 135 respectively corresponding to the scanning on the screen of the display 100.

The VRAM 140 stores the image data displayed on the screen of the display 100 in the bit map format.

A raster scan driving unit 150 reads the image data from the VRAM 140 and displays the image on the display 100 by the raster scan.

The marker operating unit 181*n* is operated by the server 11 to move the marker 108*n* for the server 11 on the screen of the display 100.

The marker operating unit 181*t* is operated by the customer 12 to move the marker 108*t* for the customer 12 on the screen of the display 100.

Each of these marker operating units 181*n* and 181*t* comprises various pointing devices such as a trackball, a mouse, a touch sensor, etc.

A first coordinate move signal control unit 182*n* generates coordinates (Xn, Yn) indicating the display position of the marker 108*n* on the screen of the display 100 from the operation signal received from the marker operating unit 181*n*, and outputs them to a marker move control unit 184 and a coordinate signal inverting unit 183. Then, the coordinates (Xn, Yn) are stored as the current coordinates of the marker 108*n*. With the movement of the marker 108*t* for the customer 12, the coordinates (Xn, Yn) input through the coordinate signal inverting unit 183 are stored as the current coordinates of the marker 108*n*.

A second coordinate move signal control unit 182*t* generates coordinates (Xt, Yt) indicating the display position of the marker 108*t* on the screen of the display 100 from the operation signal received from the marker operating unit 181*t*, and outputs them to a marker move control unit 184 and a coordinate signal inverting unit 183. With the movement of the marker 108*n* for the server 11, the coordinates (Xt, Yt) input through the coordinate signal inverting unit 183 are stored as the current coordinates of the marker 108*t*.

The coordinate signal inverting unit 183 obtains a vector of the same length in the opposite direction as the movement vector of the marker 108*n* according to the operation signal received from the marker operating unit 181*n*. The coordinates (xt, Yt) of the display position of the marker 108*t* on the screen of the display device 100 are obtained according to the vector and output to the marker move control unit 184*t* and the second coordinate move signal control unit 182*t*. The coordinate signal inverting unit 183 also obtains a vector of the same length in the opposite direction as the movement vector of the marker 108*t* according to the operation signal received from the marker operating unit 181*t*. The coordinates (Xn, Yn) of the display position of the marker 108*n* on the screen of the display device 100 are obtained according to the vector and output to the marker move control unit 184*n* and the first coordinate move signal control unit 182*n*.

The marker move control unit 184*n* selectively receives coordinate information output from the coordinate move signal control unit 182*n* or the coordinate signal inverting unit 183 and outputs to a marker write control unit 191 the movement position of the marker 108*n* on the screen of the display device 100.

The marker move control unit 184*t* selectively receives coordinate information output from the coordinate move signal control unit 182*t* or the coordinate signal inverting unit 183 and outputs to a marker write control unit 191 the movement position of the marker 108*t* on the screen of the display device 100.

The marker write control unit 191 changes the write positions of the image data of the markers 108*n* and 108*t* in the VRAM 140 according to the movement position information about the markers 108*n* and 108*t* received from the marker move control units 184*n* and 184*t*.

The operations according to the embodiment shown in FIG. 4 are explained by referring to FIG. 3.

FIG. 3 shows the VRAM 140 for the display 100 of the resolution of 8 rows×11 columns=88 picture elements.

The screen according to the embodiment is displayed in the following order.

First, the read control unit 119 reads the image data 111 from the merchandise file 110, and stores the image data 111 in the buffer 121 in line units of the vertical scanning line (each line comprising 11 picture elements).

The storage control unit 122 reads the image data of one vertical scanning line from the buffer 121, writes the data to the image memory 102*n*, and transfers it to the rotation control unit 123.

The rotation control unit 123 inverts the column position (column address) and row position (row address) of the transferred image data of one vertical scanning line, and writes the data to the image memory 102*t*.

The above described operations are performed sequentially in the order of the vertical scanning line number. The image data is written to the image memory 102*n* in the ascending order of the vertical scanning line number, and the image data is written to the image memory 102*t* in the descending order of the vertical scanning line number.

If the read control unit 119 has completed storing the image data of one line on the display 100 to the buffer 121, and the storage control unit 122 and rotation control unit 123 have completed writing the image data to the image memory 102*n* and image memory 102*t*, then the image memory 102*n* stores the dot pattern of the normal image 101*n* and the image memory 102*t* stores the dot pattern of the inverted image 101*t* (obtained by rotating the normal image 101*n* by 180 degrees) as shown in FIG. 3.

The read/write control unit 133 is activated by an instruction from the switch control unit 131. It reads the picture elements stored alternately in the image memory 102*n* and image-memory 102*t* through the selector 132 in the unit of a vertical scanning line in synchronism with the instruction from the switch control unit 131. Then the read/write control unit 133 writes the picture elements to the VRAM 140. The read addresses of the picture elements from the image memory 102*n* and 102*t* are received from the switch control unit 131. The write addresses of the read picture elements to the VRAM 140 are also received from the switch control unit 131.

The read/write control unit 133 controls to read the picture elements in the lines of even numbers (0, 2, 4, 6) from the image memory 102*n* and write them to the lines of even numbers (0, 2, 4, 6) in the VRAM 140. The read/write control unit 133 controls to read the picture elements in the lines of odd numbers (1, 3, 5, 7) from the image memory 102*t* and write them to the lines of odd numbers (1, 3, 5, 7) in the VRAM 140.

As a result, the image data as shown in the center of FIG. 3 is written to the VRAM 140. Through the operations of the holograms 71HR assigned to the vertical scanning lines of even numbers and the hologram 71HL assigned to the vertical scanning lines of odd numbers on the screen of the display device 100, both server 11 and customer 12 can view the image of the letter A stored in the image memory 102*n* and 102*t* as a normal image by seating the server 11 at N and the customer 12 at T as shown on the right in FIG. 3.

Figure 5:
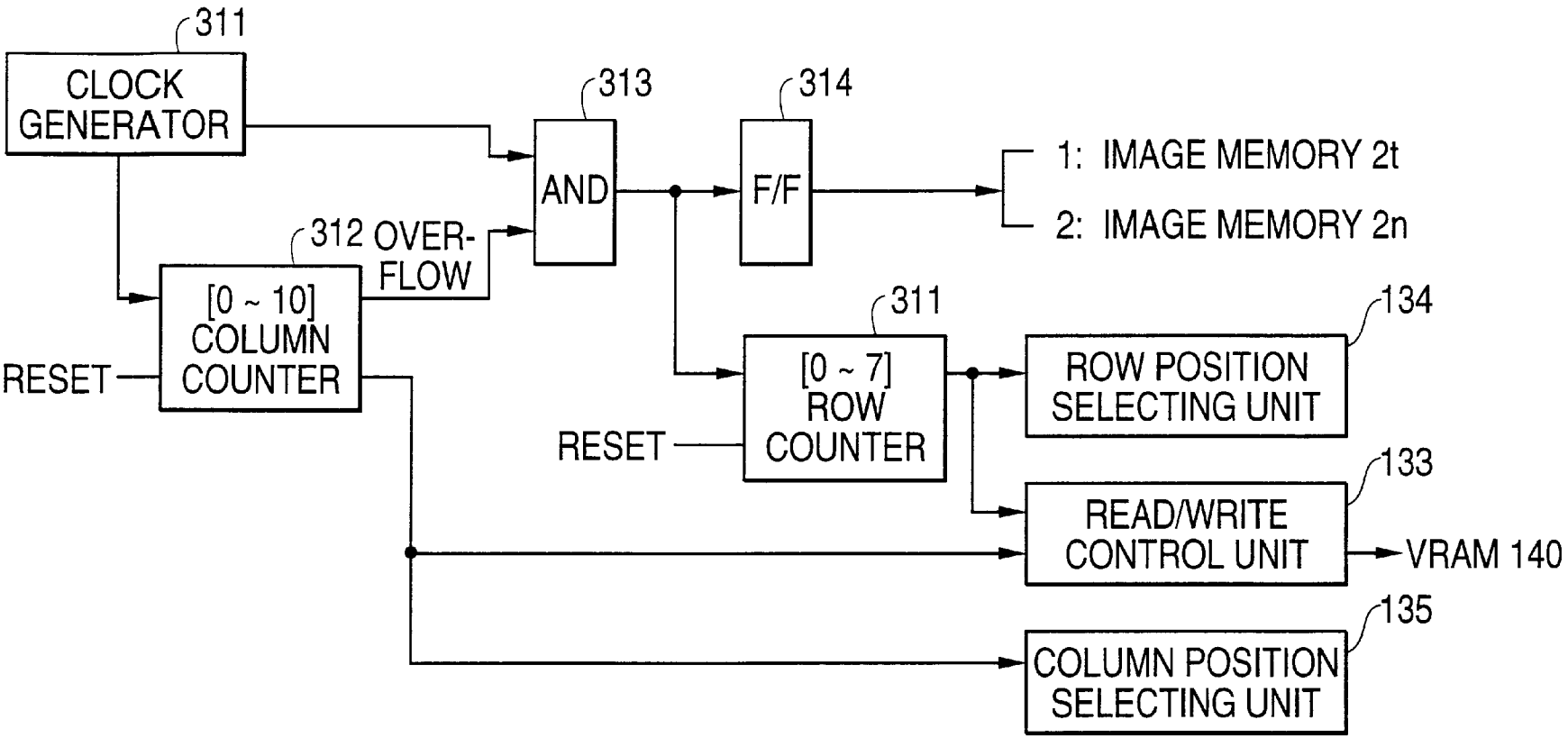
FIG. 5 is a block diagram showing the configuration of the circuit of the important portion of the switching control unit shown in FIG. 4.

FIG. 5 is a block diagram showing the configuration of the circuit of the important portion of the switch control unit 131.

A clock generator 311 generates a clock of a predetermined frequency corresponding to the scanning speed of the raster scan on the screen of the display device 100, and outputs it to a column counter 312 and an AND circuit 313.

The column counter 312 counts the pulse from 0 to 10, and outputs an overflow signal to the AND circuit 313, read/write control unit 133, and column position selecting unit 135 if the column counter 312 counts an overflow. It is reset to 0 after the overflow signal is issued.

The AND circuit 313 outputs to a flip-flop (F/F) 314 and a row counter 315 a logical product of the overflow signal received from the column counter 312 by the clock received from the clock generator 311.

The flip-flop 314 is a T-flip-flop for alternately outputting 0 and 1 according to the pulse received from the AND circuit 313. The output of the flip-flop 314 is received as a selection signal by the selector 132 shown in FIG. 4.

The selector 132 connects the image memory 102*n* to the read/write control unit 133 when "0" is received from the flip-flop 314. When "1" is received from the flip-flop 314, the selector 132 connects the image memory 102*t* to the read/write control unit 133.

The row counter 315 counts from 0 to 7 the pulse received from the AND circuit 313. When it detects an overflow, it outputs an overflow signal to the read/write control unit 133 and row position selecting unit 134. After the overflow signal is issued, the row counter 315 is reset to 0.

Described below is the operation of the important portion of the switch control unit 131.

The pulse output from the clock generator 311 enters the AND circuit 313 and column counter 312. The column counter 312 counts one each time it receives the pulse, and outputs the count value to the column position selecting unit 135 and read/write control unit 133. If the selector 132 counts 11, it outputs an overflow signal to the AND circuit 313 and is reset to 0.

The AND circuit 313 outputs the pulse received from the clock generator 311 to the flip-flop 314 and column counter 312 each time it receives the overflow signal.

The flip-flop 314 is initially set to 0, and is alternately switched to 1 and 0 each time it receives a pulse from the AND circuit 313. The row counter 315 counts 1 each time it receives the pulse. Then, it outputs the count value to the row position selecting unit 134 and read/write control unit 133.

Since the initial output of the flip-flop 314 is 0, the read/write control unit 133 is connected to the image memory 102*n* through the selector 132. The read/write control unit 133 reads the picture elements of the normal image 101*n* stored in line 0 at columns 0 through 10 in the image memory 102*n* accessed according to the row and column addresses of 0 received from the row counter 315 and 0 through 10 received from the column counter 312 as those of the VRAM 140. Then, the read/write control unit 133 outputs the read picture elements to the data bus 137 of the VRAM 140.

The output of the row counter 315 is received as the row address of the VRAM 140 by the row position selecting unit 134. The output of the column counter 312 is received as the column address of the VRAM 140 by the column position selecting unit 135. The read/write control unit 133 outputs to the data bus 137 the picture elements read from the image memory 102*n* through the control of the VRAM 140, and writes it to the VRAM 140 at the address in line 0 columns 0 through 10 according to the above described row and column addresses.

When the clock generator 311 transmits the pulses of the clock and the column counter 312 counts 11 for the pulses, the column counter 312 outputs an overflow signal to the AND circuit 313 and is reset to 0. At this time, the pulse is output from the AND circuit 313 to the flip-flop 314 and row counter 315.

Thus, the flip-flop 314 turns from 0 to 1, and retains the value 1. As a result, the value of the selection signal received by the selector 132 is 1, and the selector 132 connects the image memory 102*t* to the read/write control unit 133. The value of the row counter 315 is incremented by 1, and indicates 1.

Then, the column counter 312 counts again from 0 to 10 until the number of pulses received from the clock generator 311 reaches 22. Thus, the read/write control unit 133 reads the picture elements of the inverted image 101*t* stored in the image memory 102*t* in line 1 at columns 0 through 10 through the selector 132, and outputs the read picture elements to the data bus 137 of the VRAM 140.

The output of 1 from the row counter 315 is received as a row address of the VRAM 140 by the row position selecting unit 134. The output of 0 through 10 from the column counter 312 is received as a column address of the VRAM 140 by the column position selecting unit 135. The read/write control unit 133 outputs to the data bus 137 the picture elements read from the image memory 102*t* through the control of the VRAM 140, and writes it to the VRAM 140 at the address in line 1 columns 0 through 10 according to the above described row and column addresses.

Each time the number of pulses output from the clock generator 311 reaches 33, 44, 55, 66, or 77, the value of the row counter 315 is sequentially incremented one by one to 3, 4, 5, 6, and 7. When the value of the row counter 315 reaches 8, the row counter 315 indicates an overflow and is reset to 0, thereby completing the write to the VRAM 140 of the normal image 101*n* stored in the image memory 102*n* and the inverted image 101*t* stored in the image memory 102*t*.

As a result, the picture elements stored in lines 0, 2, 4, and 6 in the image memory 102*n* are written to lines 0, 2, 4, and 6 in the VRAM 140, and the picture elements stored in lines 1, 3, 5, and 7 in the image memory 102*t* are written to lines 1, 3, 5, and 7 in the VRAM 140 as shown in the center of FIG. 3.

Thus, the image in the VRAM 140, in which the normal image 101*n* and inverted image 101*t* are alternately written in line units, is read by the raster scan driving unit 150 at a predetermined scan rate in order of the raster scan on the display 100. Then, the read image is displayed on the screen of the display device 100. Since the hologram 71HR is provided for the vertical scanning line of lines 0, 2, 4, and 6 on the screen of the display device 100 while the hologram 71HL is provided for the vertical scanning line of lines 1, 3, 5, and 7 on the screen of the display device 100 corresponding to each picture element, the picture elements written to the VRAM 140 are viewed as the normal image 101*n* represented by ● stored in lines of even numbers (lines 0, 2, 4, and 6) in the VRAM 140 or as the inverted image 101*t* represented by ♦ stored in lines of odd numbers (lines 1, 3, 5, and 7) in the VRAM 140 depending on the position on the display 100 as shown on the right in FIG. 3.

That is, the server 11 views the normal image 101*n* as shown at the right bottom in FIG. 3 while the customer 12 simultaneously views the inverted image 101*t* as shown above the normal image 101*n* as shown at the left upper in FIG. 3. Therefore, both server 11 and customer 12 can view the letter A as a normal image.

In the explanation above, the resolution of the display 100 is 8 lines×11 picture elements. However, according to the present embodiment, the system can be freely designed depending on the resolution of the display available to the user. For example, if the resolution of the display is 640 lines ×480 picture elements corresponding to the video graphics array (VGA), the VRAM 140 can be used with memory for the storage capacity of 307,200 picture elements. The column counter 312 should count 0 through 637, and the row counter 315 should count 0 through 479. In addition to the above described VGA, the present embodiment can be easily applied to another resolution such as a super video graphics array (SVGA), etc.

The operations of displaying a pair of markers 108*n* and 108*t* on the screen of the display device 100 are described below by referring to FIG. 6–FIG. 10.

The markers 108*n* and 108*t* are represented as image patterns of, for example, 16×16, 24×24, or 32×32 picture elements. A point in the image pattern is defined as a display reference position.

Figures 7A, 7B:
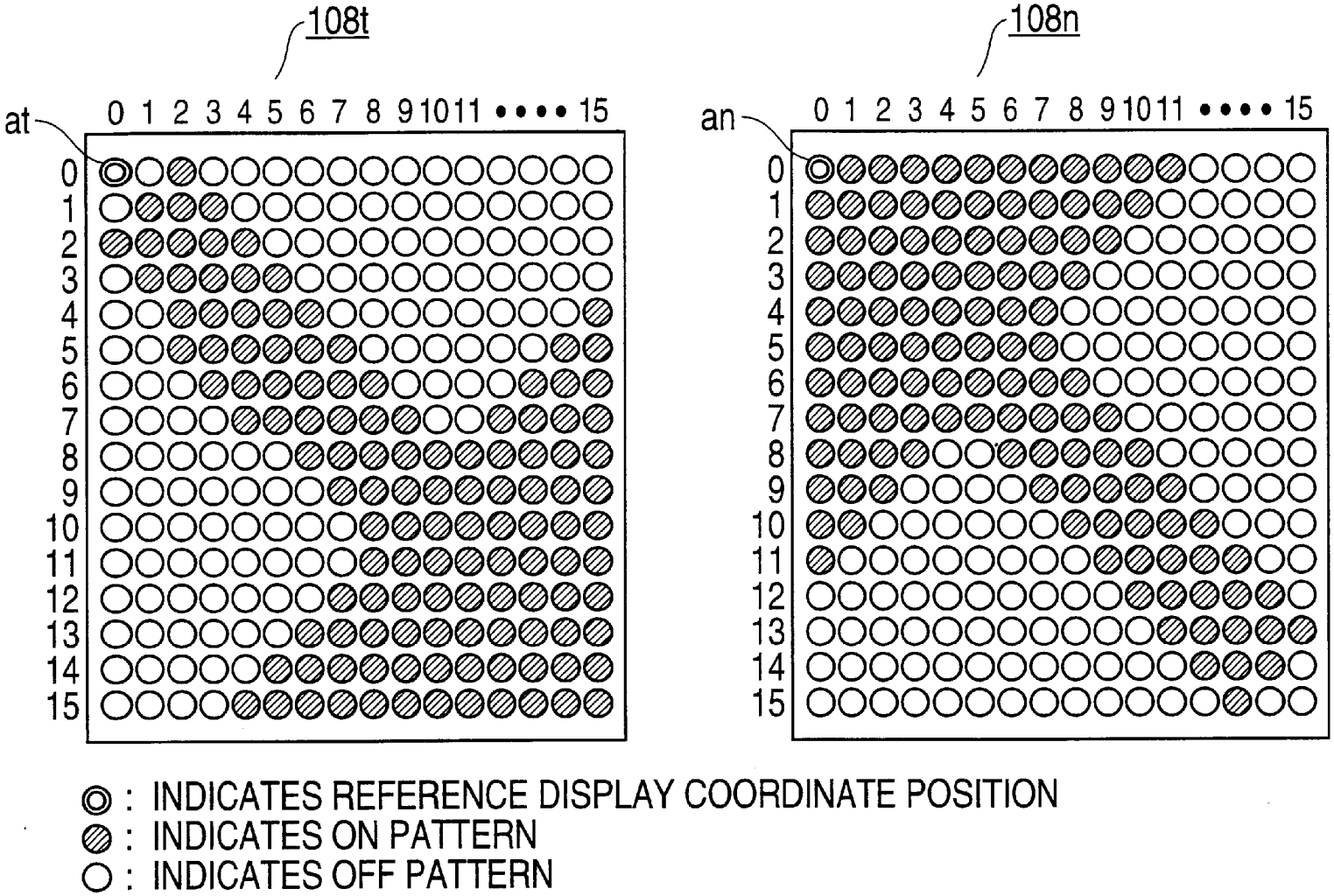
FIGS. 7A and 7B show the image patterns of the markers for the server and customer respectively.

FIGS. 7A and 7B shows the 16×16-picture-element image patterns of the marker 108*t* for the customer 12 and the marker 108*n* for the server 11. In FIGS. 7A and 7B, ● indicates a black picture element (picture elements to be displayed) and ○ indicates a white picture element (a picture element not displayed). FIG. 7B shows the screen coordinates an (Xn, Yn) of the display 100 to be used as a reference display position of the marker 108*n* for the server 11, and the screen coordinates at (Xt, Yt) of the display 100 to be used as a reference display position of the marker 108*t* for the customer 12. The screen coordinates an (Xn, Yn) and at (Xt, Yt) can be set at other positions in each image pattern. In the explanation below, the maximum coordinates (Xmax, Ymax) are defined for the screen of the display 100.

To display the marker 108*t* at the position where the marker 108*t* is symmetric to the marker 108*n* about the center of the screen, the reference display position coordinates at (Xt, Yt) should be determined as follows.

$$Xt=X\max-Xn$$

$$Yt=Y\max-Yn$$

Figure 6:
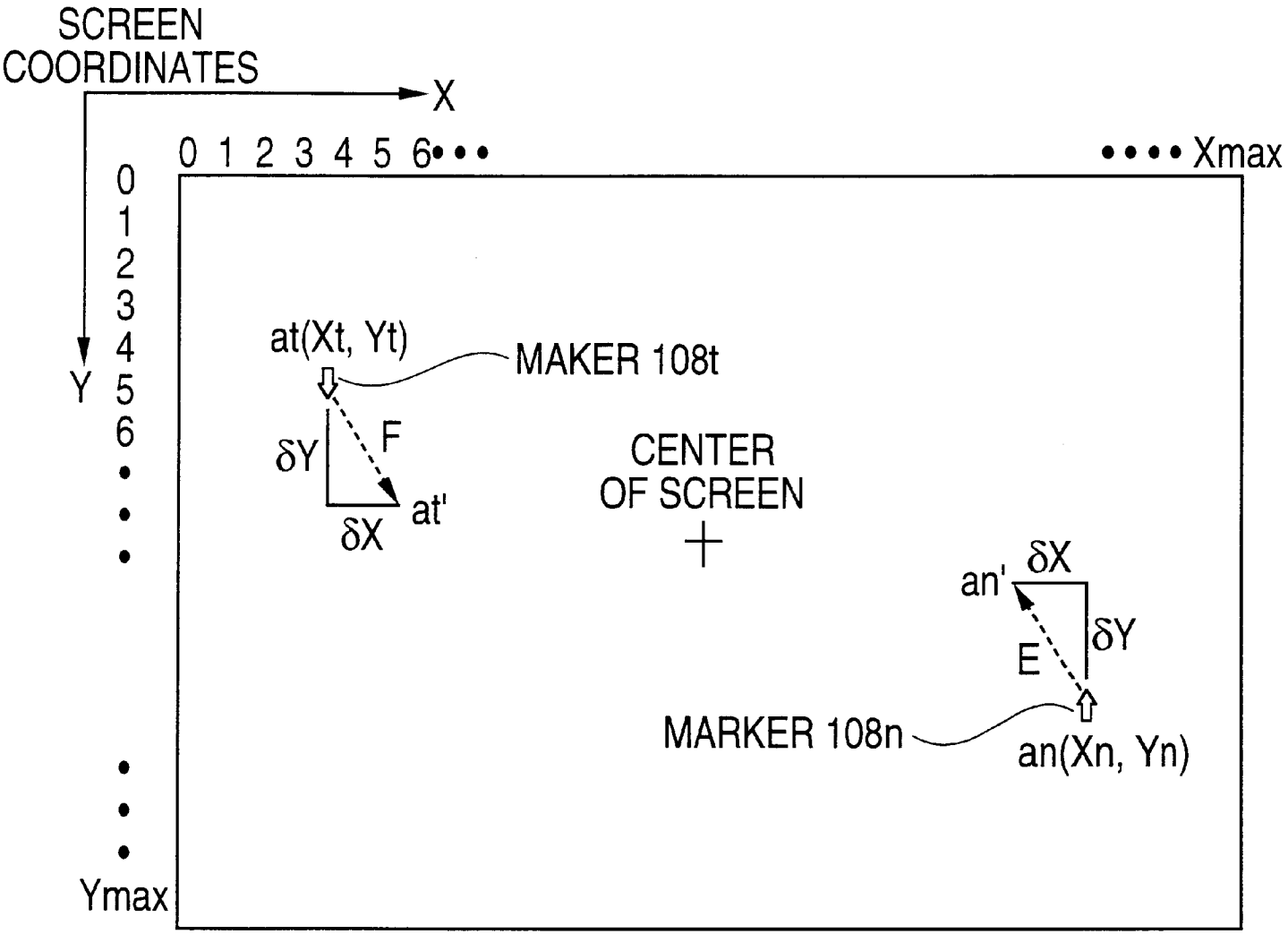
FIG. 6 shows the marker moving operation.

If the server 11 operates the marker operating unit 181*n* to move the marker 108*n* from the coordinates an to the coordinates an' such that the coordinate values of X and Y decrease as indicated by the arrow E of broken line shown in FIG. 6, then the variations δX, δY (δX<0, δY<0) in coordinates through the movement are sequentially output from the marker operating unit 181*n* to the coordinate move signal control unit 182*n* and coordinate signal inverting unit 183.

The coordinate move signal control unit 182*n* adds the entered coordinates variations (δX, δY) to the coordinates an (Xn, Yn), and calculates the coordinates an' (Xn', Yn') as the result of the movement of the marker 108*n* by the following equation.

$$Xn'=Xn+\delta X$$

$$Yn'=Yn+\delta Y$$

The coordinate move signal control unit 182*n* notifies the marker move control unit 184*n* of the coordinates an' (Xn', Yn') calculated as the result of the movement together with the present coordinates an (Xn, Yn) of the marker 108*n*. Then, the coordinates an' (Xn', Yn') as the result of the movement are stored as the present coordinates an (Xn, Yn).

The coordinate signal inverting unit 183 obtains the present coordinates at (Xt, Yt) of the marker 108*t* stored by the coordinate move signal control unit 182*t* from the coordinate move signal control unit 182*t*, subtracts the coordinates variations (δX, δY) of the marker 108*n* from the present coordinates at (Xt, Yt), and calculates the coordinates at' (Xt', Yt') as the result of the movement of the marker 108*t* by the following equation.

$$Xt'=Xt-\delta X$$

$$Yt'=Yt-\delta Y$$

The coordinates at' (Xt', Yt') as the result of the movement are provided for the marker move control unit 184*t*, and are simultaneously stored as the present coordinates at (Xt, Yt) in the coordinate move signal control unit 182*t*.

If the customer 12 operates the marker operating unit 181*t* to move the marker 108*t* from the coordinates at (Xt, Yt) to the coordinates at' (Xt', Yt') such that the coordinate values of X and Y increase as indicated by the arrow F of broken line shown in FIG. 6, then the variations δX, δY (δX>0, δY>0) in coordinates through the movement are sequentially output from the marker operating unit 181*t* to the coordinate move signal control unit 182*t* and coordinate signal inverting unit 183.

The coordinate move signal control unit 182*t* adds the entered coordinates variations (δX, δY) to the coordinates at (Xt, Yt), and calculates the coordinates at' (Xt', Yt') as the result of the movement of the marker 108*t* by the following equation.

$$Xt'=Xt+\delta X$$

$$Yt'=Yt+\delta Y$$

The coordinate move signal control unit 182*t* notifies the marker move control unit 184*t* of the coordinates at' (Xt', Yt') calculated as the result of the movement together with the present coordinates at (Xt, Yt) of the marker 108*t*. Then, the coordinates at' (Xt', Yt') as the result of the movement are stored as the present coordinates at (Xt, Yt).

The coordinate signal inverting unit 183 obtains the present coordinates an (Xn, Yn) of the marker 108*t* stored by the coordinate move signal control unit 182*n* from the coordinate move signal control unit 182*t*, subtracts the coordinates variations (δX, δY) of the marker 108*t* from the present coordinates an (Xn, Yn), and calculates the coordinates an' (Xn', Yn') as the result of the movement of the marker 108*t* by the following equation.

$$Xn'=Xn-\delta X$$

$$Yn'=Yn-\delta Y$$

The coordinates an' (Xn', Yn') as the result of the movement are provided for the marker move control unit 184*n*, and are simultaneously stored as the present coordinates an (Xn, Yn) in the coordinate move signal control unit 182*t*.

As described above, the markers 108*n* and 108*t* are immediately informed of each other's operation. The output of the marker operating units 181*n* and 181*t* are exclusively controlled such that the output of one marker operating unit is inactive when the other marker operating unit is active. The output (present coordinates an, at and coordinates an', at' as the result of the movement) of the marker move control unit 184*n* and marker move control unit 184*t* is input to the marker write control unit 191.

Figure 8:
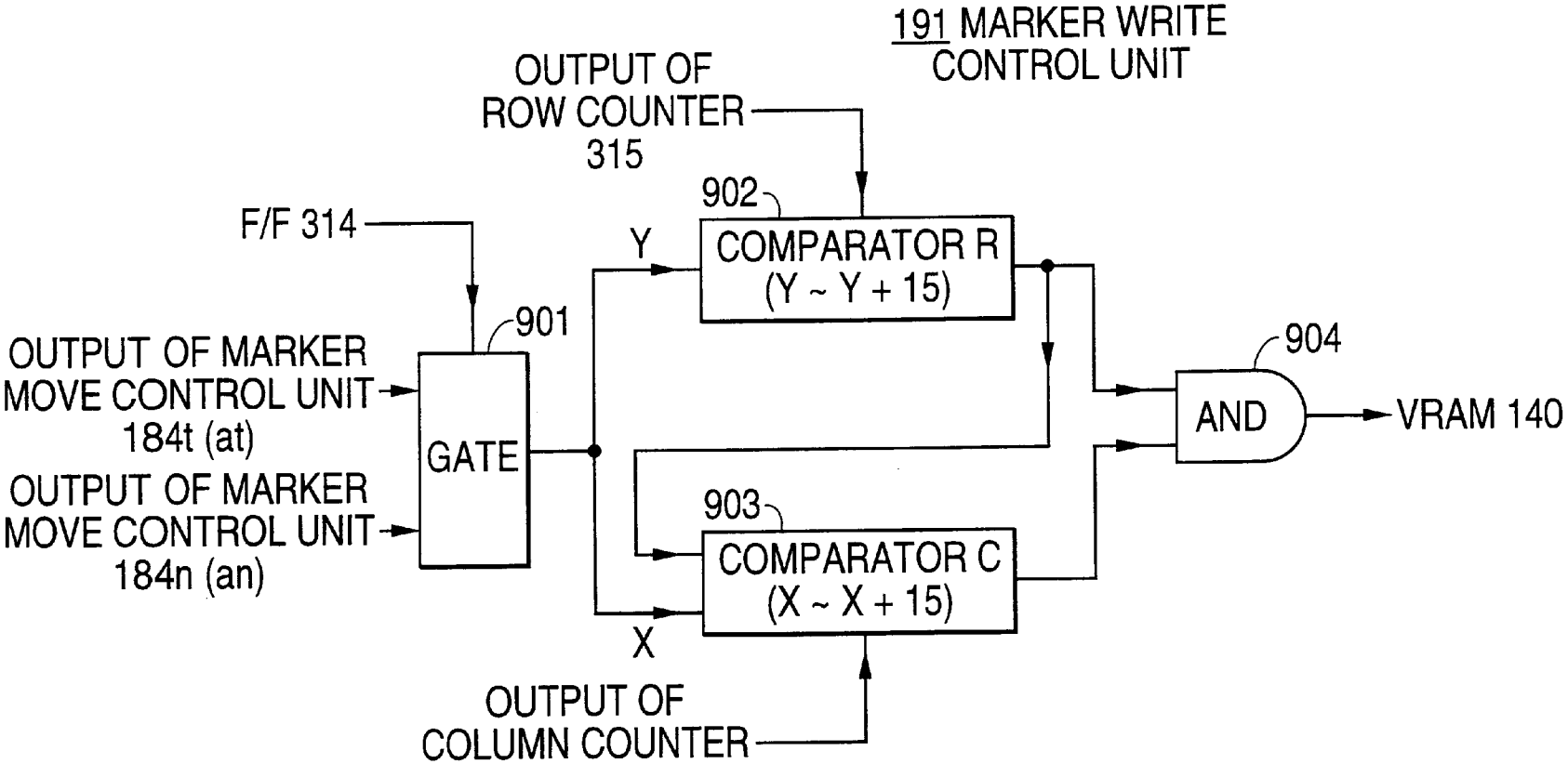
FIG. 8 is a block diagram showing an example of the configuration of the circuit of the marker write control unit shown in FIG. 4.

FIG. 8 is a block diagram showing an example of the configuration of the circuit of the important portion of the marker write control unit 191.

The marker write control unit 191 comprises a gate 901; comparators R902 and C903; and an AND circuit 904 for controlling the output from the comparators C903 and C903.

The gate 901 receives the present coordinates an (Xn, Yn) of the marker 108*n* and the present coordinates at (Xt, Yt) of the marker 108*t* from the marker move control units 184*n* and 184*t* respectively, and also receives the value of the flip-flop 314 in the switch control unit 131 shown in FIG. 4.

The gate 901 selects the input an (Xn, Yn) from the marker move control unit 184*n* or the input at (Xt, Yt) from the marker move control unit 184*t* according to the value of the flip-flop 314, and outputs the result to the comparator R902 and comparator C903. That is, when the output of the flip-flop 314 is 0, it selects and outputs the input an (Xn, Yn) from the marker move control unit 184*n*. When the output of the flip-flop 314 is 1, it selects and outputs the input at (Xt, Yt) from the marker move control unit 184*t*.

The comparator R902 receives from the gate 901 and stores the value Y (Yn or Yt) of the Y coordinate of either the output an from the marker move control unit 184*n* or the output at from the marker move control unit 184*t*. The comparator C903 receives from the gate 901 and stores the value X (Xn or Xt) of the X coordinate of either the output an from the marker move control unit 184*n* or the output at from the marker move control unit 184*t*.

As described above, each time the column counter 412 counts and detects an overflow, the output of the flip-flop 314 is alternately switched to 1 and 0, and the row counter 415 counts up the rows as shown in FIG. 5.

When the output of the flip-flop 314 is 0, the value of the row counter 415 is an even number (0, 2, 4, . . . ). When the output of the flip-flop 314 is 1, the value of the row counter 415 is an odd number (1, 3, 5, . . . ).

Figure 9:
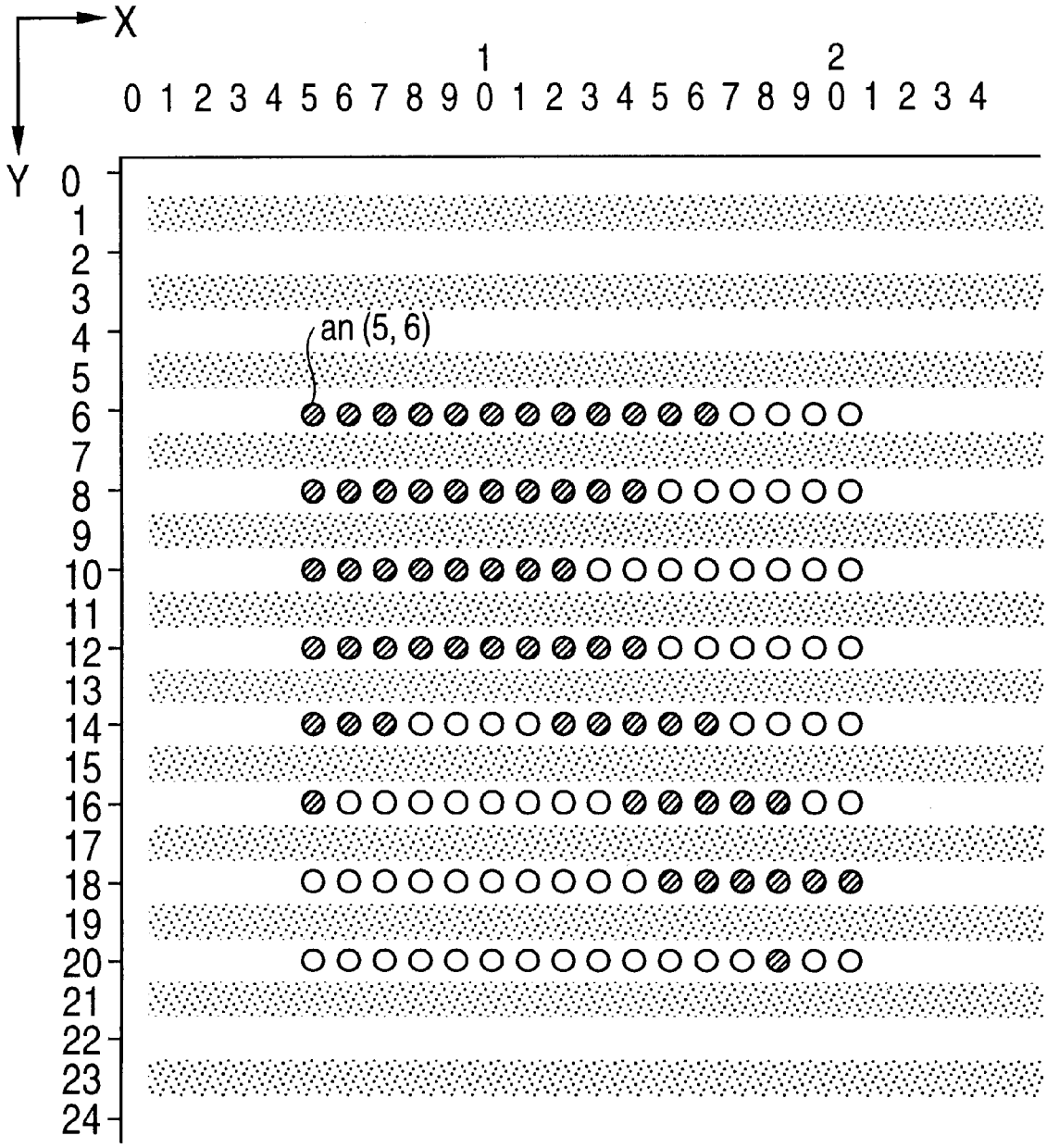
FIG. 9 shows the operation of the marker write control unit.

In the following descriptions, the resolution of the display 100 is VGA (640×480 picture elements), the column counter 412 outputs the values 0 through 639, and the row counter 415 outputs the values 0 through 479. The size of the image pattern of the markers 108*n* and 108*t* is 16×16 picture elements (refer to FIGS. 7A and 7B). As shown in FIG. 9, the screen of the display 100 is provided with the holograms 71HR and 71HL such that the picture-elements deflection direction is switched for each vertical scanning line. That is, the holograms 71HR and 71HL are provided such that the vertical scanning lines of even numbers (0, 2, 4, . . . 478) are viewed by the server 11 while the vertical scanning lines of odd numbers (1, 3, 4, . . . 479) are viewed by the customer 12.

The comparator R902 compares the value received from the row counter 415 with the stored value Y, and outputs a signal of 1 to the AND circuit 904 and comparator C903 if the input value is in the range from Y to Y+15.

While the above described signal of 1 is entered from the comparator R902, the comparator C903 compares the value input from the 412 with the stored X value, and outputs to the AND circuit 904 the stored picture element signal of the marker 108*n* or 108*t* if the input value is in the range from X to X+15.

While the signal of 1 is applied from the comparator R902, the AND circuit 904 outputs the picture element signal of the markers 108*n* and 108*t* received from the comparator C903 to the data bus 137 of the VRAM 140.

FIG. 9 shows the image pattern of the marker 108*n* written to the VRAM 140 by the marker write control unit 191 if the reference display coordinates output from the marker move control unit 184*n* are an (Xn Yn).

As shown in FIG. 9, the picture elements in lines 1, 3, 5, 7, 9, 11, 13, and 15 of the image pattern of the marker 108*n* shown in FIG. 7B are written at the column addresses 5 through 20 of the row addresses 6, 8, 10, 12, 14, 16, 18, and 20 of the VRAM 140. Since the lines of even numbers on the display 100 are visible by the server 11 as described above, the image of the marker 108*n* shown in FIG. 9 is visible only by the server 11.

If the reference display coordinates at (Xt, Yt) of the marker 108*t* output from the marker move control unit 184*t* by the gate 901 is input to the comparator R902 and comparator C903, then the picture elements in the lines of even numbers in the image pattern of the marker 108*t* shown in FIG. 7A are written at the column addresses Yt through Yt+15 of the row addresses Xt, Xt+2, Xt+4, . . . , Xt+14 in the VRAM 140.

Figure 10:
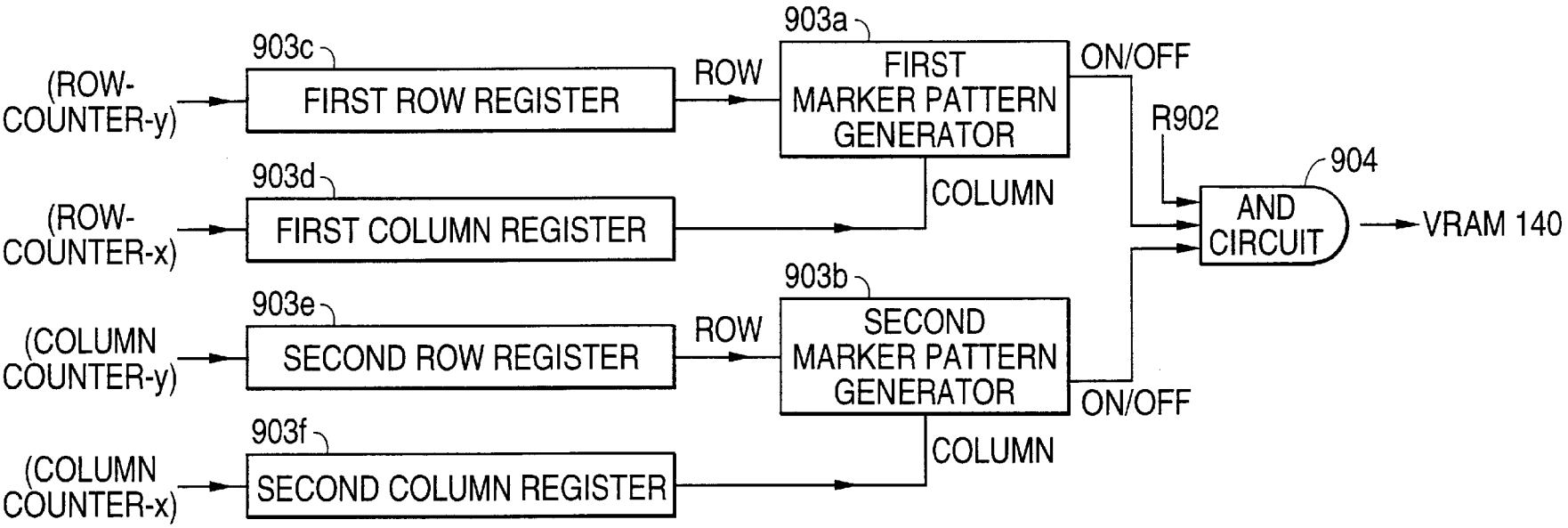
FIG. 10 is a block diagram showing an example of the configuration of the circuit of the comparator C903 shown in FIG. 8.

FIG. 10 is a block diagram showing the configuration of the circuit in the comparator C903.

A first marker pattern generator 903*a* stores the image pattern (marker pattern as a normal image) of the marker 108*n* shown in FIG. 7B.

A second marker pattern generator 903*b* stores the image pattern (marker pattern as an inverted image) of the marker 108*t* shown in FIG. 7A.

A first row register 903*c* and first column register 903*d* respectively output the row and column addresses to the first marker pattern generator 903*a*. A second row register 903*e* and second column register 903*f* respectively output the row and column addresses to the second marker pattern generator 903*b*.

The values of the first row register 903*c* and second row register 903*e* depends on the comparator R902. That is, the comparator R902 sets the difference of AddY−Y in the first row register 903*c* if the row address AddY received from the row counter 415 is in the range from Y to Y+15 and is an even number (refers to a line of an even number). The comparator R902 sets the difference of AddY−Y in the second row register 903*e* if the row address AddY received from the row counter 415 is in the range from Y to Y+15 and is an off number (refers to a line of an odd number). If the row address AddY received from the row counter 415 is not in the range from Y to Y+15, the comparator R902 resets the first row register 903*c* and second row register 903*e*.

When the X coordinate AddX of the horizontal scanning line on the display 100 received from the column counter 412 in the range from X to X+15, the difference AddX−X is set in the first column register 903*d* and second column register 903*f* by the comparator C903.

Described below are the operations of the comparator C903.

While the signal of 1 is input from the comparator R902, the comparator C903 reads the image pattern of the marker 108*n* or marker 108*t* from the first marker pattern generator 903*a* or second marker pattern generator 903*b* according to the value of the flip-flop 314, and outputs the result to the AND circuit 904. Since the AND circuit 904 has received the signal of 1 from the comparator R902, the AND circuit 904 outputs the image pattern of the received marker 108*n* or marker 108*t* to the VRAM 140.

That is, if the value of the flip-flop 314 is 0, then the row counter 415 outputs the row address of an even number and the output an (Xn, Yn) of the marker move control unit 184*n* passes through the gate 901. Accordingly, the comparator C903 makes effective the output of the first row register 903*c* and first column register 903*d*, reads the picture elements of the marker 108*n* at the address determined by the value of the first row register 903*c* and first column register 903*d* of the first marker pattern generator 903*a*, and outputs the result to the AND circuit 904 while the output of the column counter 412 is in the range from X to X+15. Since the AND circuit 904 has received the signal of 1 from the comparator R902, the picture elements of the marker 108*n* are output to the VRAM 140 through the AND circuit 904 and data bus 137.

On the other hand, if the value of the flip-flop 314 is 1, then the row counter 415 outputs the row address of an odd number and the output at (Xt, Yt) of the marker move control unit 184*n* passes through the gate 901. Accordingly, the comparator C903 makes effective the output of the first row register 903*c* and second column register 903*f*, reads the picture elements of the marker 108*t* at the address determined by the value of the second row register 903*e* and second column register 903*f* of the first marker pattern generator 903*a*, and outputs the result to the AND circuit 904 while the output of the column counter 412 is in the range from X to X+15. Since the AND circuit 904 has received the signal of 1 from the comparator R902, the picture elements of the marker 108*n* are output to the VRAM 140 through the AND circuit 904.

As described above, the picture elements of the marker 108*n* or marker 108*t* output to the VRAM 140 are written to the VRAM 140 at the address according to the row address set in the row position selecting unit 304 and the column address set in the column position selecting unit 135 shown in FIG. 4. Then, they are read by the raster scan driving unit 150 from the VRAM 140 and displayed on the screen of the display 100.

Only the marker 108*n* is viewed by the server 11 while only the marker 108*t* is viewed by the customer 12 through the operations of the holograms 71HR and 71HL as shown on the right in FIG. 3.

According to the embodiment of the present invention described below, a liquid-crystal blocking unit is used instead of the hologram.

Figure 11:
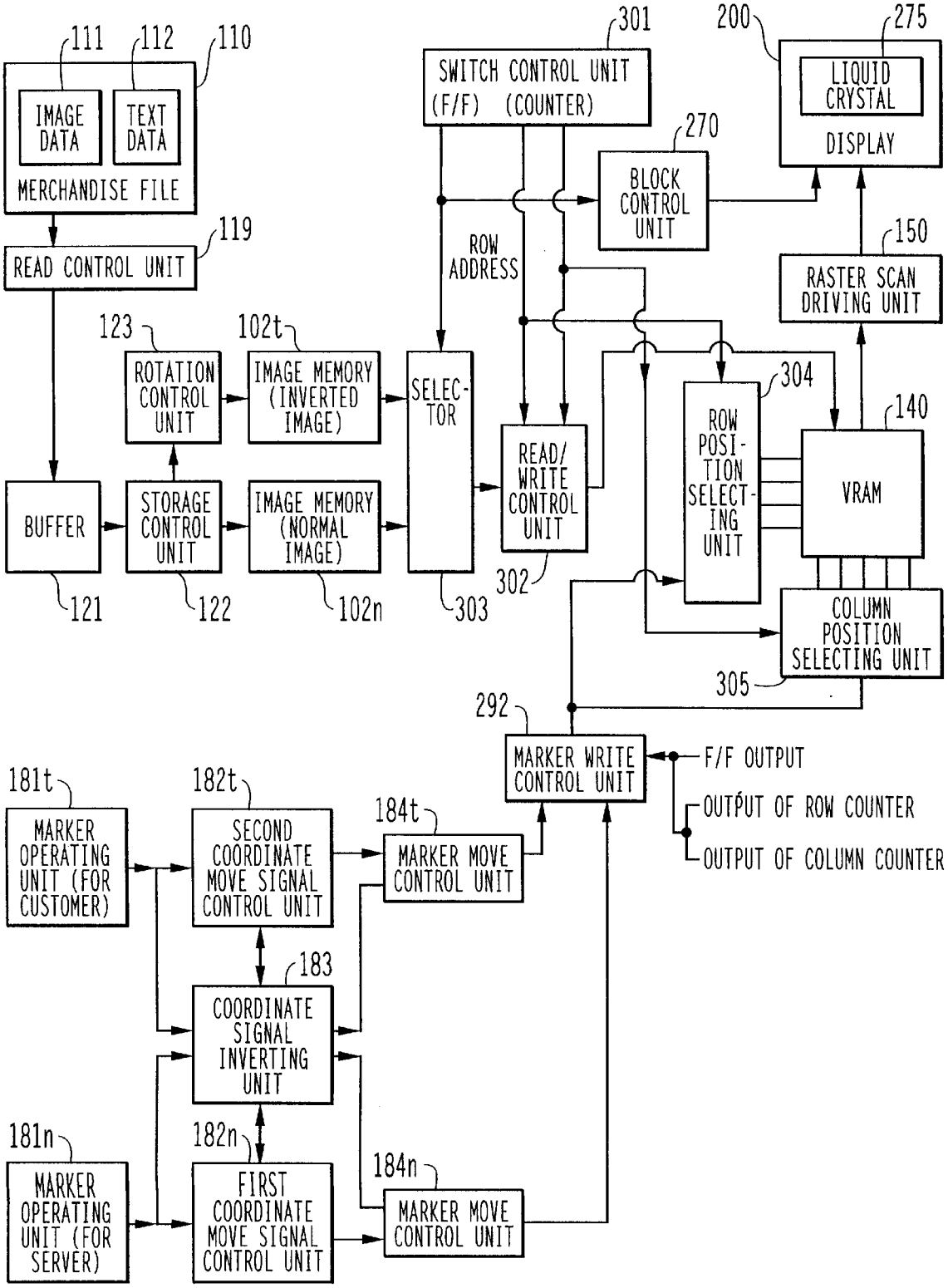
FIG. 11 is a block diagram showing the configuration of the circuit according to the second embodiment of the present invention.

FIG. 11 is a block diagram showing the configuration of the circuit according to the present embodiment.

In FIG. 11, the block also shown in FIG. 4 is assigned the same identification number.

The display according to the second embodiment shown in FIG. 11 is different from the first embodiment shown in FIG. 4 in that each screen is switched at a high speed. According to the first embodiment, an image on a screen containing the images for both server 11 and customer 12 is displayed on a predetermined cycle.

A display 200 according to the second embodiment contains a liquid crystal 275 between the picture elements and the screen. The liquid crystal 275 deflects the light radiating from the picture elements on the screen so that the image is blocked and kept out of the vision of the customer 12 and only the server 11 can view the image when the image for the server 11 written to the VRAM 140 should be displayed on the screen of the display 200. The liquid crystal 275 deflects the light radiating from the picture elements on the screen so that the image is blocked and kept out of the vision of the server 11 and only the customer 12 can view the image when the image for the customer 12 written to the VRAM 140 should be displayed on the screen of the display 200.

A block control unit 270 controls the liquid crystal 275 so that the liquid crystal 275 can successfully function as the above described blocking material.

A switch control unit 301 outputs a signal to notify the block control unit 270 of the timing of switching the deflection through the liquid crystal 275, and also outputs a connection switch signal to a selector 303. It also outputs row and column addresses in the VRAM 140 to a read/write control unit 302 and a column position selecting unit 305.

The selector 303 alternately connects the image memory 102*n* and image memory 102*t* to the read/write control unit 302 according to the connection switch signal received from the switch control unit 301.

The read/write control unit 302 writes to the VRAM 140 the normal image 101*n* received through the selector 303 and stored in the image memory 102*n* and the inverted image 101*t* stored in the image memory 102*t* alternately on the screen. The write address information is received from the switch control unit 301.

The row position selecting unit 304 receives a row address in the VRAM 140 from the switch control unit 301, and latches and outputs the address as a row address signal to the VRAM 140.

The column position selecting unit 305 receives a column address in the VRAM 140 from the switch control unit 301, and latches and outputs the address as a column address signal to the VRAM 140.

A marker write control unit 292 writes the image of the marker 108*n* to the VRAM 140 according to the coordinates an (Xn, Yn) prior to the movement of the marker 108*n* and the coordinates an' (Xn', Yn') as the result of the movement of the marker 108*n* received from the marker move control unit 184*n*. The marker write control unit 292 writes the image of the marker 108*t* to the VRAM 140 according to the coordinates at (Xt, Yt) prior to the movement of the marker 108*t* and the coordinates at' (Xt', Yt') as the result of the movement of the marker 108*t* received from the marker move control unit 184*t*.

The image of the marker 108*n* is written together with the image (normal image 101*n*) for the server 11, and the image of the marker 108*t* is written together with the image (inverted image 101*t*) for the customer 12.

Described below is the operations according to the second embodiment with the above described configuration.

When the image for the server 11 is displayed on the screen of the display 200, the block control unit 270 controls the deflecting function of the liquid crystal 275 so that the image displayed on the screen of the display 200 can be viewed only by the server 11 and is kept out of the vision of the customer 12 at the instruction from the switch control unit 131. Thus, the normal image 101*n* for the server 11 is viewed only by the server 11 and cannot be viewed by the customer 12.

The selector 303 receives the instruction from the switch control unit 301 and connects the image memory 102*n* to the read/write control unit 302. The read/write control unit 302 reads all the picture elements of the normal image 101*n* from the image memory 102*n* without skipping the scanning lines, and writes them to the VRAM 140. At this time, the marker write control unit 292 writes the image of the marker 108*n* at the position in the VRAM 140 specified by the marker operating unit 181*n*. The raster scan driving unit 150 displays on the screen of the display 200 the normal image 101*n* written to the VRAM 140 and the image of the marker 108*n*.

When the image for the customer 12 is displayed on the screen of the display 200, the block control unit 270 controls the deflection through the liquid crystal 275 so that the image displayed on the screen of the display 200 can be viewed only by the customer 12 and is kept out of the vision of the server 11 at the instruction from the switch control unit 131. Thus, the inverted image 101*t* for the customer 12 is viewed only by the customer 12 and cannot be viewed by the server 11.

The selector 303 receives the instruction from the switch control unit 301 and connects the image memory 102*t* to the read/write control unit 302. The read/write control unit 302 reads all the picture elements of the inverted image 101*t* from the image memory 102*t* without skipping the scanning lines, and writes them to the VRAM 140. At this time, the marker write control unit 292 writes the image of the marker 108*t* at the position in the VRAM 140 specified by the marker operating unit 181*t*. The raster scan driving unit 150 displays on the screen of the display 200 the inverted image 101*t* written to the VRAM 140 and the image of the marker 108*t*.

Figure 12:
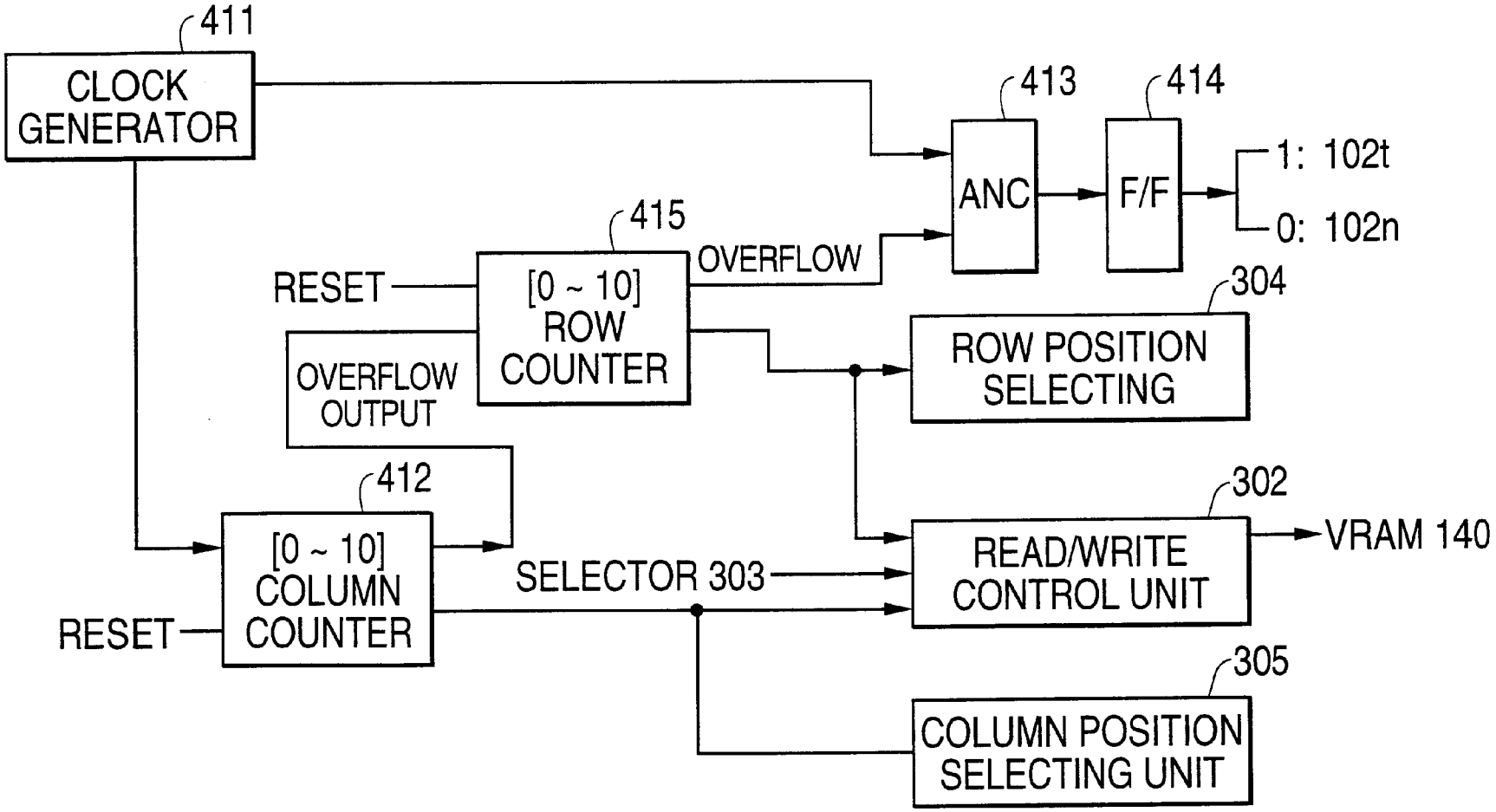
FIG. 12 is a block diagram showing the configuration of the circuit of the important portion of the switching control unit shown in FIG. 11.

FIG. 12 is a block diagram showing the configuration of the circuit of the important portion of the switch control unit 301.

A clock generator 411 generates a clock of a predetermined frequency corresponding to the scanning speed of the raster scan, and outputs the clock to a column counter 412 and an AND circuit 413.

The column counter 412 counts the number of pulses of the clock from 0 to 10. When it counts an overflow, it outputs an overflow signal to the row counter 415, row counter 315, and read/write control unit 302. After issuing the overflow signal, the column counter 412 is reset to 0.

The row counter 415 counts from 0 to 7 the number of the overflow signals received from the column counter 412, and outputs an overflow signal to a flip-flop 414, the row position selecting unit 304, and read/write control unit 302. After issuing the overflow signal, the row counter 415 is reset to 0.

The AND circuit 413 outputs the pulse received from the clock generator 411 to the flip-flop 414 each time it receives the overflow signal from the row counter 415.

The flip-flop 414 alternately outputs 0 and 1 according to the pulse received from the AND circuit 413. The output of the flip-flop 414 is received as a selection signal by the selector 303 shown in FIG. 11.

The selector 303 connects the image memory 102*n* to the read/write control unit 133 when 0 is received from the flip-flop 414. If 1 is received from the flip-flop 414, the selector 303 connects the image memory 102*t* to the read/write control unit 133.

If 0 is received from the flip-flop 414, the block control unit 270 shown in FIG. 11 controls the deflection through the liquid crystal 275 such that all the picture elements on the screen of the display 200 can be viewed only by the server 11 and be kept out of the vision of the customer 12. If 1 is received from the flip-flop 414, the block control unit 270 controls the deflection through the liquid crystal 275 such that all the picture elements on the screen of the display 200 can be viewed only by the customer 12 and be kept out of the vision of the server 11.

The row counter 415 counts from 0 to 7 the number of the pulses received from the AND circuit 313, and outputs an overflow signal to the read/write control unit 302 and row position selecting unit 304. After issuing the overflow signal, the row counter 415 is reset to 0.

Described below are the operations of the important portion of the switch control unit 301.

In the following explanation, the storage capacity of the VRAM 140 is assumed to be 8 rows×11 columns for comprehensibility.

The pulse output from the clock generator 311 is input to the AND circuit 413 and column counter 412. The column counter 412 increases 1 for its count value by 1 each time the pulse is input. The column counter 412 outputs the count value to the row counter 315 and read/write control unit 302. When it counts 11, it outputs an overflow signal to the row counter 415 and is reset to 0.

The row counter 415 increases 1 for its count value each time an overflow signal is received from the column counter 412, and outputs a total count value to the row position selecting unit 304 and read/write control unit 302. When it counts 8, it outputs an overflow signal and is reset to 0. Therefore, the row counter 415 outputs an overflow signal each time the number of the pulses generated by the clock generator 411 reaches a multiple of 88. The overflow signal is output to the AND circuit 413.

The flip-flop 414 is initially set to 0, and alternately outputs 0 and 1 each time a pulse is received from the AND circuit 413. Therefore, the output of the flip-flop 414 is initially 0, and then 1 and 0 alternately.

The selector 303 shown in FIG. 11 connects the image memory 102*n* to the read/write control unit 302 when the flip-flop 414 outputs 0, and connect the image memory 102*t* to the read/write control unit 302 when the flip-flop 414 outputs 1. As described above, an overflow signal is input from the row counter 415 to the AND circuit 413 each time the number of pulses generated by the clock generator 411 reaches a multiple of 88. Therefore, the output of the flip-flop 414 is 0 until the number of the pulses generated by the clock generator 411 reaches 89, and the selector 303 connects the image memory 102*n* to the read/write control unit 302.

The row counter 415 outputs a count value to the row position selecting unit 304 and read/write control unit 302.

Accordingly, the read/write control unit 133 is connected with the image memory 102*n* through the selector 132 until the number of pulses generated by the clock generator 411 reaches 88. The read/write control unit 133 reads the picture elements of the normal image 101*n* from the image memory 102*n* through the selector 303 according to the count value received from the row counter 315 and the count value received from the column counter 312, and writes them to the VRAM 140.

Thus, the image of the normal image 101*n* written to the VRAM 140 is displayed by the raster scan driving unit 150 on the display 200 on a predetermined cycle. At this time, the normal image 101*n* is viewed only by the server 11 and is kept out of the vision of the customer 12 through the control by the block control unit 270.

If the number of pulses generated by the clock generator 411 reaches 89, then an overflow signal is output from the row counter 415 to the AND circuit 413, the AND circuit 413 outputs a pulse to the flip-flop 414, and the output from the flip-flop 414 changes from 0 to 1.

Since the next overflow signal is output from the row counter 415 when the number of pulses generated by the clock generator 411 reaches 178, the flip-flop 414 holds 1 until then.

Thus, the selector 303 connects the image memory 102*t* to the read/write control unit 133 until the number of pulses generated by the clock generator 411 indicates 89 through 177. During this period, the column counter 412 continues indicating 0 through 10 eight times and increases by 1 the value of the row counter 415 from 0 to 7. The value of the row counter 415 is input as a row address in the VRAM 140 to the row position selecting unit 304. The value of the column counter 412 is input as a column address in the VRAM 140 to the row counter 315. These values are also output to the read/write control unit 302.

The read/write control unit 302 reads the picture elements of the inverted image 101*t* from the image memory 102*t* through the selector 303 according to the values from the row counter 415 and column counter 412, and writes them at the address in the VRAM 140 according to the above described row and column addresses. Thus, the inverted image 101*t* written to the VRAM 140 is displayed by the raster scan driving unit 150 on the display 200 on a predetermined cycle. The inverted image 101*t* can be viewed only by the customer 12 and is kept out of the vision of the server 11 through the control by the block control unit 270.

The above described operations are repeated at a high speed with the number of the pulses "88" generated by the clock generator 411 defined as one cycle. In synchronism with the cycle, the block control unit 270 switches the deflection by the liquid crystal 275 such that the image displayed on the display 200 can be viewed alternately by the server 11 and customer 12. That is, the screen of the display 200 is switched alternately for the server 11 and customer 12 on a predetermined cycle according to the second embodiment.

The marker write control unit 292 writes a pair of the images of the marker 108*n* and marker 108*t* input through the marker move control unit 184*n* and marker move control unit 184*t* at the address in the VRAM 140 corresponding to the position specified by the marker operating unit 181*n* and marker operating unit 181*t*. Thus, the marker 108*n* is displayed with the image for the server 11, and the marker 108*t* is displayed with the image for the customer 12.

The above described cycle of switching the display on the screen should be preferably 10 through 15 times, and the most preferably 30 times, per second to display the images without flicker using the after-image effect.

Figure 13:
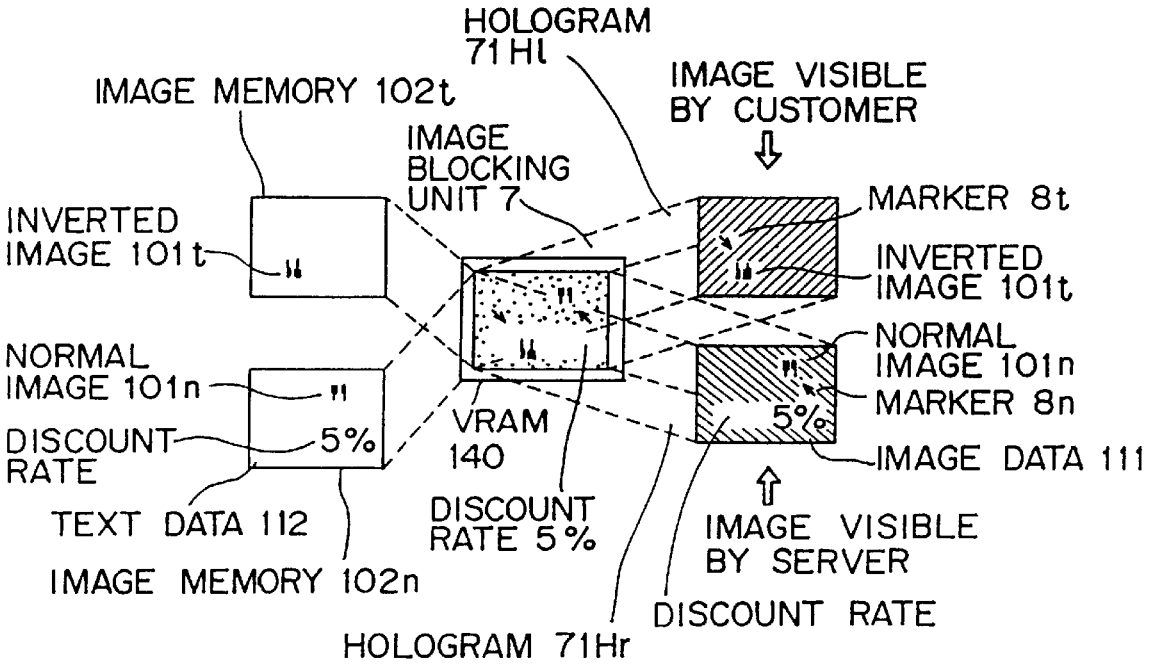
FIG. 13 shows an example of displaying only for the server the information about the image displayed on the screen of the display device according to the first embodiment shown in FIG. 4.

FIG. 13 shows an example of displaying the information about the displayed image on the screen of the display 200 according to the first embodiment of the present invention.

In this example, the image data 111 is read with the text data 112 from the merchandise file 110 shown in FIG. 4. The image data 111 is written to both image memory 102*n* and image memory 102*t* while the text data 112 is written only to the image memory 102*n*. The text data 112 is information the server 11 would not like the customer 12 to see on the screen of the display 200 during the sales talk with the customer 12. For example, the text data 112 can be a price list, a discount rate list, etc.

The merchandise file 110 stores the image data 111 and text data 112 in the individual formats. When reading the text data 112 from the merchandise file 110, the read control unit 119 adds a predetermined flag to the data and writes it to the buffer 121. When reading the text data 112 from the buffer 121, the storage control unit 122 recognizes that the text data 112 has been read according to this flag. The text data 112 is written only to the image memory 102*n* and is not transferred to the rotation control unit 123.

Since the text data 112 is only written to the image memory 102*n*, the text data 112 can be viewed only by the server 11 when it is displayed on the screen of the display 100.

Thus, the server 11 reads the discount rate list of a merchandise from the merchandise file 110 and displays it on the screen of the display 100 when the customer 12 demands a discount for the merchandise while the server 11 communicates with the customer 12. In this method, the server 11 can determine whether or not and to what extent the discount can be allowed in response to the customer's demand without disclosure of the list to the customer.

Figure 14A:
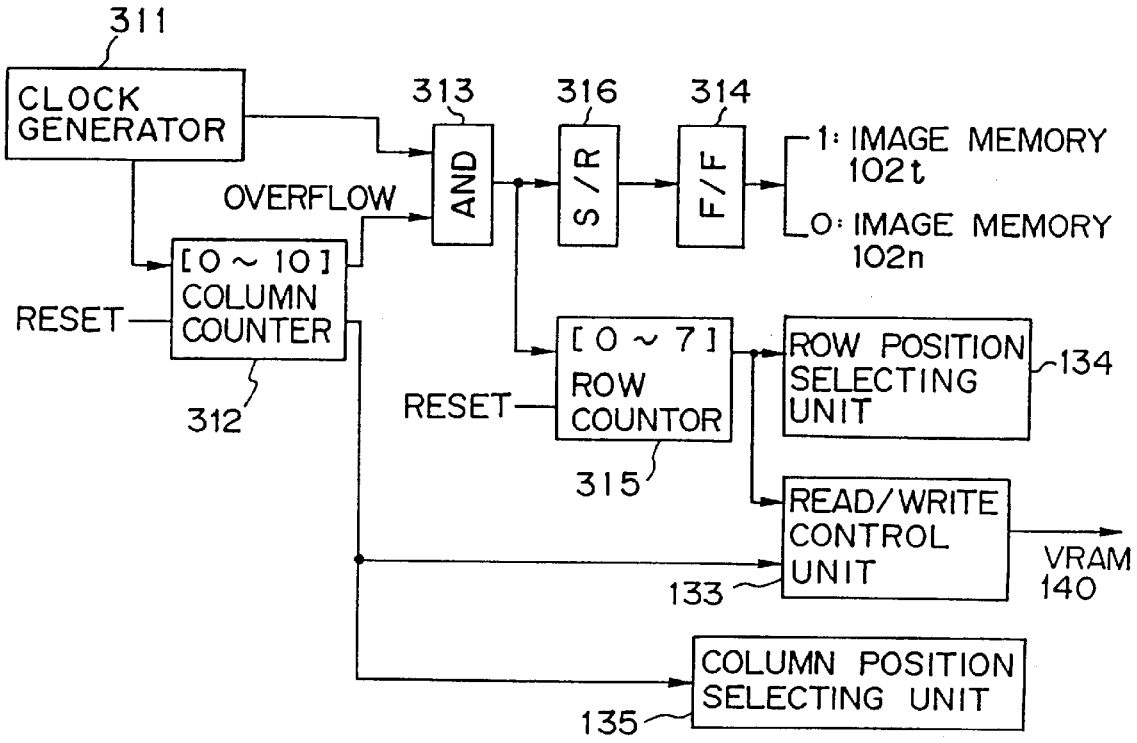
FIG. 14A is a block diagram showing a variation of the important portion of the switching control unit according to the embodiment shown in FIG. 6.
Figure 14B:
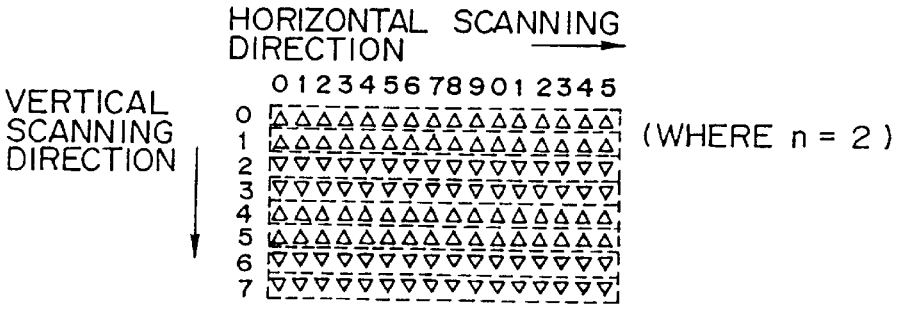
FIG. 14B shows an arrangement pattern of the holograms according to the variation shown in FIG. 14A.

FIGS. 14A and 14B show examples of variations of the first embodiment shown in FIG. 4.

The examples are the methods of displaying the normal image 101*n* and inverted image 101*t* alternately on the screen of the display 100 for every n adjacent vertical scanning lines.

FIG. 14A is a block diagram showing the configuration of the circuit of the important portion of the switch control unit 131 shown in FIG. 4. FIG. 14B shows the distribution pattern of the holograms 71HR and holograms 71HL provided along the vertical scanning lines on the screen of the display 100. In FIG. 14B, Δ indicates the hologram 71HR, and Δ indicates the hologram 71HL. That is, in this example, the holograms 71HR and 71HL are arranged alternately every two adjacent vertical scanning lines.

The blocks shown in FIG. 5 as well as in 14A are assigned the same identification numbers. FIG. 14A is different from FIG. 5 in shift register 316 between the AND circuit 313 and flip-flop 314. The shift register 316 outputs a pulse to the flip-flop 314 each time n pulses are input from the AND circuit 313. With this configuration, the output from the flip-flop 314 initialized to 0 with n=2 is 1 and 0 alternately each time the value of the row counter 315 indicates 2, 4, and 8.

The selector 132 connects to the read/write control unit 133 the image memory 102*n* when the value of the flip-flop 314 is 0 and the image memory 102*t* when the value of the flip-flop 314 is 1. Therefore, with the configuration of the switch control unit 131 designed as shown in FIG. 14A, the image stored in the image memory 102*n* is written to the VRAM 140 in lines 0 and 1 shown in FIG. 3, and the image stored in the image memory 102*t* is written to the VRAM 140 in lines 2 and 3. Likewise, the image stored in the image memory 102*n* is written to the VRAM 140 in lines 4 and 5, and the image stored in the image memory 102*t* is written to the VRAM 140 in lines 6 and 7, thereby completing the write of the image for the screen.

Thus, the image memory 102*n* and image memory 102*t* are written alternately every two lines to the VRAM 140 shown in FIG. 4. The mixture of the normal image 101*n* and inverted image 101*t* is read by the raster scan driving unit 150 from the VRAM 140 and displayed on the screen of the display 100. Since the holograms 71HR and 71HL are provided alternately every two vertical scanning lines as shown in FIG. 14B, the picture elements of the normal image 101*n* in the VRAM 140 in lines 0, 1, 4, and 5 is viewed only by the server 11 while the picture elements of the inverted image 101*t* in the VRAM 140 in lines 2, 3, 6, and 7 is viewed only by the customer 12.

Figure 15:
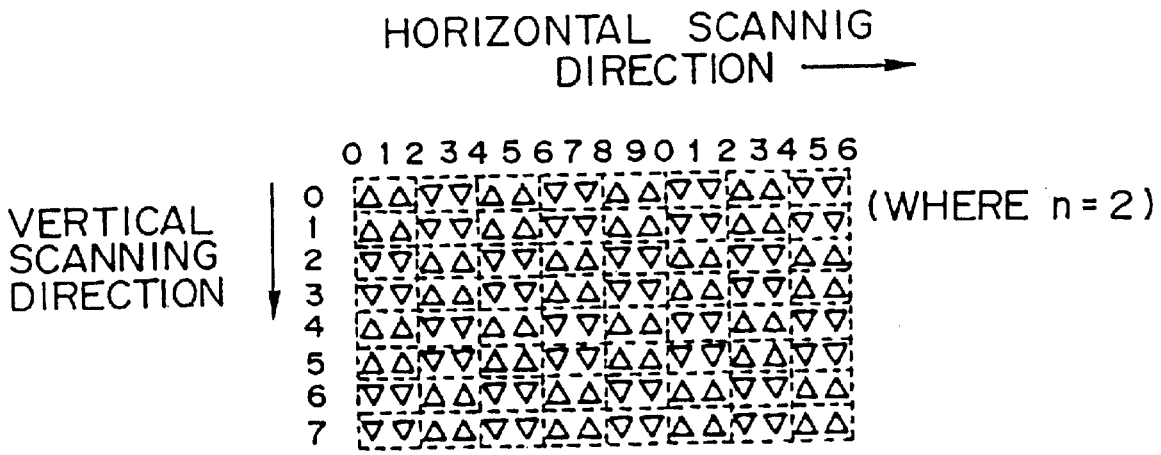
FIG. 15 shows a variation of the arrangement pattern of the holograms according to the present invention.

FIG. 15 shows another example of the distribution pattern of the holograms 71HR and 71HL. In FIG. 15, as in FIG. 14B, Δ indicates the hologram 71HR, and Δ indicates the hologram 71HL.

In this example, the picture elements in the vertical scanning lines are grouped in a plurality of picture elements (in the 2-picture-element checker-board pattern in this example). The holograms 71HR and 71HL are arranged alternately in the 2-picture-element block units. In this example, the picture elements of the normal image 101*n* stored in the block units in the image memory 102*n* and the picture elements of the normal image 101*t* stored in the block units in the image memory 102*t* are written to the VRAM 140.

FIGS. 16A through 16C show other examples of the distribution patterns of the holograms 71HR and 71HL.

In these examples, the screen of the display is divided into two sections, an upper section and a lower section, when the image memory 102*n* and image memory 102*t* are smaller than the screen of the display. The sections are used as exclusive screens for the server 11 and customer 12.

The holograms 71HR are provided for the screen section for the server 11 while the holograms 71HL are provided for the screen section for the customer 12 so that the image displayed on the screen section exclusive for one cannot be viewed by the other. In this case, the VRAM 140 is also divided into two areas, that is, a picture element write area for the server screen 140R and a picture element write area for the customer screen 140L corresponding to the above described divided screen sections (a broken line 141 indicates a boundary between the sections in FIG. 16A). The example in FIG. 16A shows the state of the picture elements written to the VRAM 140 when the character string ABC should be simultaneously viewed by the server 11 and customer 12.

As shown in FIG. 16A, the images of the character string ABC are written to the picture element write area for the server screen 140R and picture element write area for the customer screen 140L as 180 degrees rotated from each other. That is, the image data of the ABC is written to the picture element write area for the server screen 140R such that the character string can be viewed as a normal image by the server 11 while it is written to the picture element write area for the server screen 140L such that the character string can be also viewed as a normal image by the customer 12.

FIG. 16B shows the image viewed by the server 11 on the screen of the display 100 when the image data of the ABC is written to the VRAM 140 as shown in FIG. 16A. As shown in FIG. 16B, the server 11 cannot see the upper screen section on the display 100 through the operations of the holograms 71HL, but can see the image of the ABC as a normal image displayed on the lower screen section on the display 100.

FIG. 16C shows the image viewed by the customer 12 on the screen of the display 100 when the image data of the ABC is written to the VRAM 140 as shown in FIG. 16A. As shown in FIG. 16C, the customer 12 cannot see the upper screen section on the display 100 through the operations of the holograms 71HR, but can see the image of the ABC as a normal image displayed on the lower screen section (corresponding to the upper screen section) on the display 100.

In this example, both server 11 and customer 12 can simultaneously view the same image of the same resolution. In this case, the screen of the display is divided into the upper and lower screen sections. However, it can also be divided into right and left screen sections.

Figure 17:
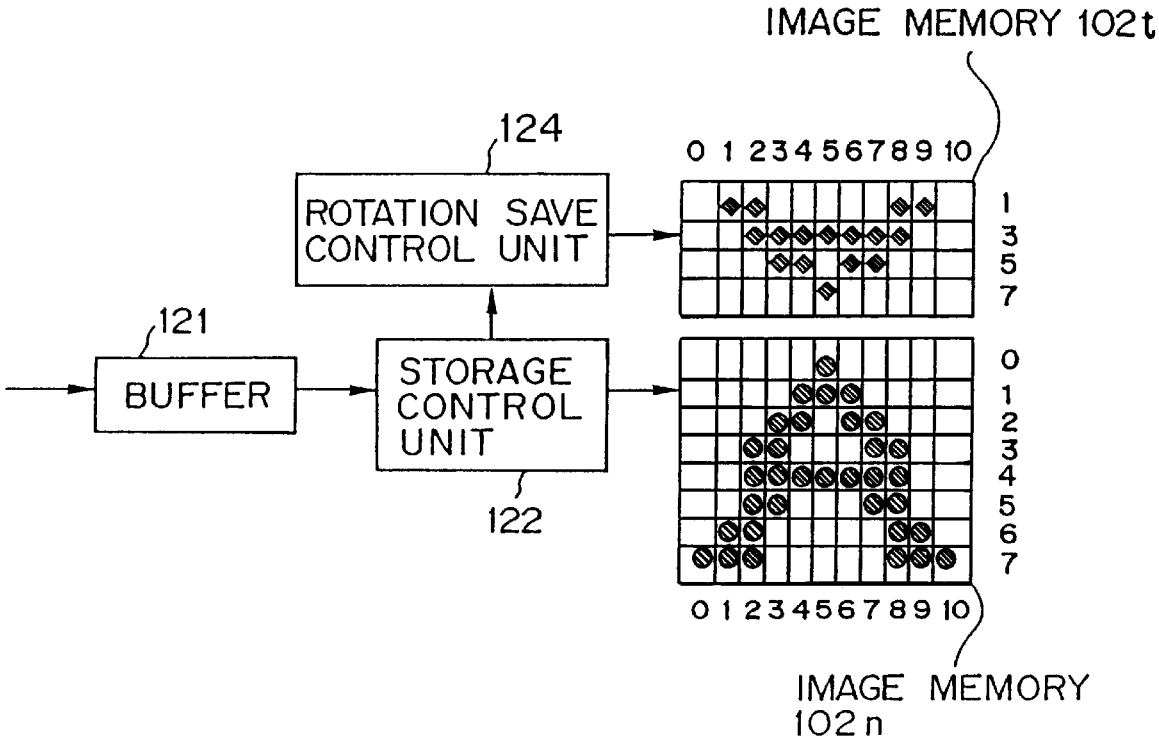
FIG. 17 shows a variation of the embodiment according to FIG. 4.

FIG. 17 shows another example of the first embodiment shown in FIG. 4.

The example shown in FIG. 17 shows the method of saving the storage capacity of the image memory 102*t*. That is, the image memory 102*n* and image memory 102*t* store the entire picture elements of both normal image 101*n* and inverted image 101*t* as shown in FIG. 3 according to the embodiment shown in FIG. 4. According to the present embodiment, the picture elements are written to the image memory 102*n* or image memory 102*t* with the picture elements not written to the VRAM 140 partially omitted.

According to the example shown in FIG. 17, the picture elements of the inverted image 101*t* are stored in the image memory 102*t* with the picture elements in the lines of even numbers omitted when the holograms 71HL are arranged along the vertical scanning lines of odd numbers on the display 100 and the holograms 71HR are arranged along the vertical scanning lines of even numbers on the display 100. The picture elements of the inverted image 101*t* are written to the image memory 102*t* by a rotation save control unit 124.

That is, one line of picture elements read by the read control unit 119 from the merchandise file 110 and written to the buffer 121 are read by the storage control unit 122.

Then, the storage control unit 122 writes the one line of picture elements to the corresponding line in the image memory 102*n*, and also transfers it to the rotation save control unit 124.

The rotation save control unit 124 is provided with a line counter for counting the number of lines, in which the picture elements are written, of the image memory 102*t* to discard the picture elements in the lines, of the picture elements in lines transferred from the storage control unit 122 and write to the image memory 102*t* only the picture elements in the lines of odd numbers. As a result, the picture elements only in lines 1, 3, 5, and 7 of the inverted image 101*t* are written to the image memory 102*t* as shown in FIG. 17, thereby saving the storage capacity of the image memory 102*t* by approximately 50%.

Although data is stored in the image memory 102*t* with the inverted image 101*t* partially omitted according to the example shown in FIG. 17, the data can be stored in the image memory 102*t* with the inverted image 101*t* partially omitted. Furthermore, the data can also be stored in both image memory 102*n* and image memory 102*t* with both normal image 101*n* and inverted image 101*t* partially omitted.

The omitted lines should be exclusive for either the normal image 101*n* or inverted image 101*t*. That is, if the lines of even numbers are omitted for the normal image 101*n*, then the lines of odd numbers are omitted for the inverted image 101*t*. If the lines of off numbers are omitted for the normal image 101*n*, then the lines of odd numbers are omitted for the inverted image 101*t*. When the omitted lines are specified, the arrangement of the holograms 71HR and 71HL on the display 200 should be properly maintained.

Figure 18:
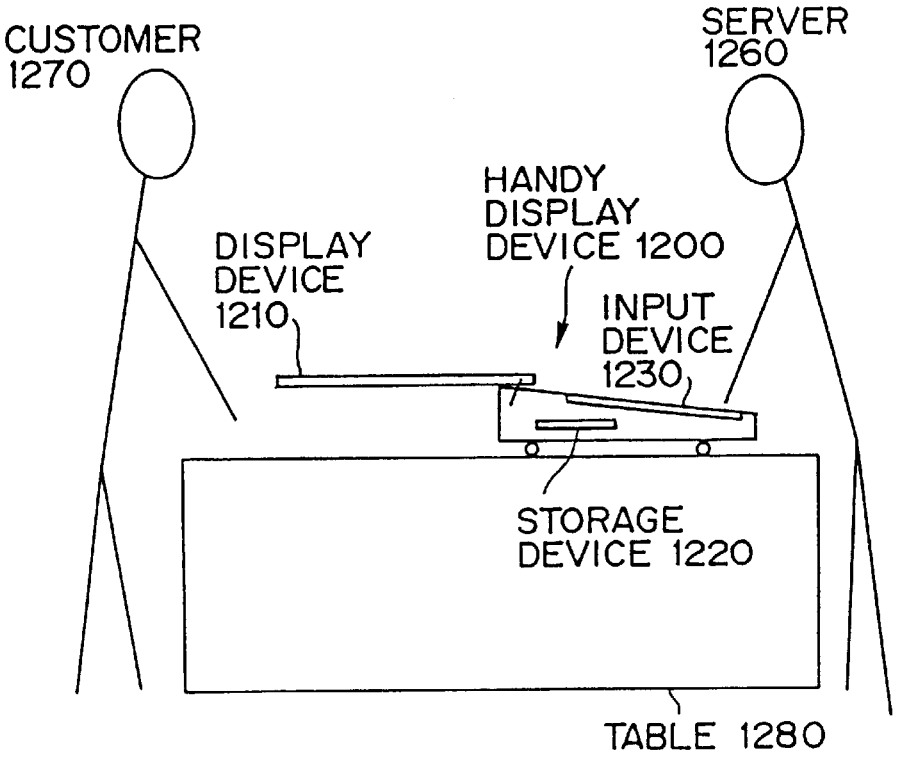
FIG. 18 shows the general configuration of a handy display device according to the embodiment of the present invention.

FIG. 18 shows a handy display device 1200 according to the present invention.

The handy display device 1200 comprises a display device 1210 using the above described hologram and liquid-crystal; a storage device 1220 for storing the merchandise file 110 shown in FIG. 4; and an input device 1230 provided with a keyboard, pointing device, etc.

The storage device 1220 is, for example, a floppy disk device, CD-ROM device, etc., loaded with easily removable storage media for storing the merchandise file 100. In the handy display device 1200 shown in FIG. 18, the display device 1210 can be open with the display screen surface horizontally. Therefore, the handy display device 1200 can be placed on a table 1300 so that a server 1260 and a customer 1270 sit face to face with a table 1280 set between them and watch the of the display device 1210. Therefore, the server 1260 and customer 1270 can communicates with each other while observing the same image as a normal image as in the above described embodiment. The server 1260 can optionally operate the marker displayed on the screen of the display device 1210 through the marker move control unit provided in the input device 1230.

Figure 19:
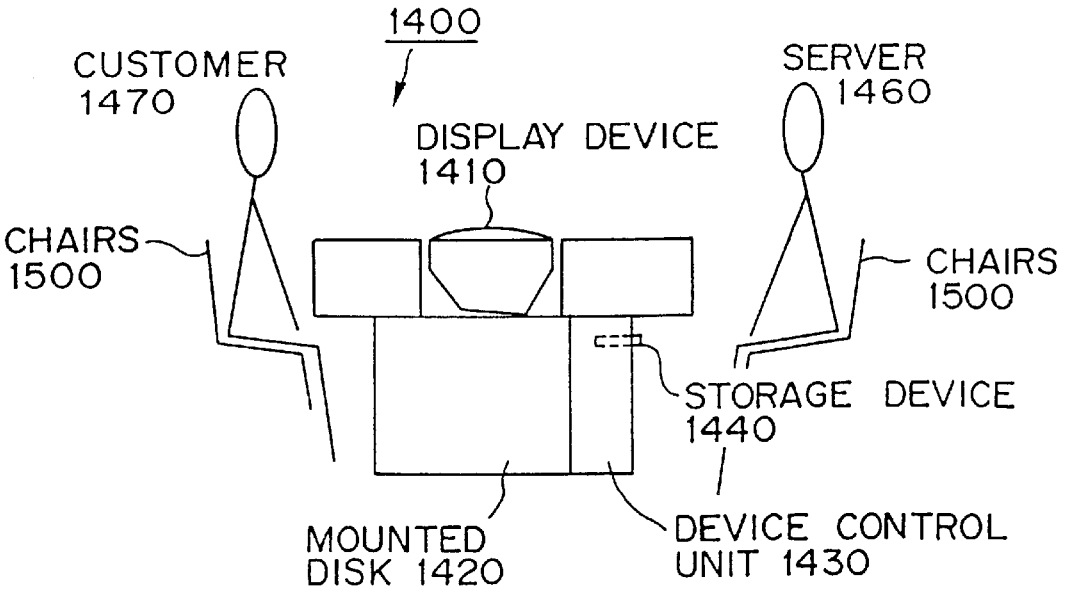
FIG. 19 shows the general configuration of a desktop display device according to another embodiment of the present invention.

FIG. 19 shows an example in which the present invention is applied to a desktop display device 1400.

The desktop display device 1400 comprises a display device 1410 using the above described hologram and liquid-crystal; a mounted desk 1420 onto which the display device 1410 is provided at the central concave portion; a device control unit 1430 for controlling the entire device incorporated into the mounted disk 1420; a storage device 1440 for storing the storage device storing the merchandise file 110 shown in FIG. 4., etc. The storage media can be optionally removable from and set onto, for example, the storage device 1440, etc.

When the desktop display device 1400 is used, a server 1460 and a customer 1470 communicate with each other sitting face to face on chairs 1500 with the mounted disk 1420 set between them. The display screen faces upward, and the server 1460 and customer 1470 can view the same image as a normal image on the display screen. Although not shown in FIG. 19, the mounted disk 1420 can be provided with the marker operating units on either side of the mounted disk 1420 so that the server 1460 and customer 1470 can freely operate the marker displayed on the display screen of the display device 1410.

According to the present embodiment, data can be displayed on monochrome or multi-color monitors.

The markers 108*n* and 108*t* can be displayed in synchronism with the display of the normal image 101*n* and inverted image 101*t*. The size and form can be optional. If information is displayed in multiple colors, the marker 108*n* and marker 108*t* can be displayed in an optional color, and even in different colors.

According to the above described embodiment, holograms or liquid crystal is used in the blocking unit. However, other light-deflecting units such as lenticular lenses, parallax lenses, plasma display units, etc.

The operating unit for moving the markers 108*n* and 108*t* can be any of other units such as a mouse, joystick, pad, sensor, tentacle, write pen, etc.

The present invention can be effectively applied at the counters and windows of financial organizations, tourist bureaus, realtors, official organizations, government offices, various festivals and meetings, ticket boxes, etc. If the system according to the present invention are applied at these counters and windows, customers or applicants for the services can view various materials on the screen as normal images with the servers who sit face to face with the customers with the screens of the display devices setting between them. Since the servers and clients can point to important portions of the materials being checked on the screens using the markers displayed on the screens, the servers can concentrate on the sales communications with the customers. Necessary information can be further retrieved from the files stored on the storage media, and therefore the servers can answer the inquiries from the customers and efficiently process their requests and problems.

If the present invention is applied to the display devices of handy terminal units, salesmen can visit their customers and use the display devices in presenting catalogs for the customers. When the catalog are displayed on the screens of the display devices, the servers can display more information (for example, price and discount information, etc.) additionally with their own images to successfully proceed with the sales communications.

What is claimed is:

1. A double-screen display device comprising:

displaying memory means for storing an image;

display means for displaying the image stored in said displaying memory means, said display means consisting of a screen with a smooth surface;

image writing means for writing to said displaying memory means a first image and a second image symmetrical to the first image about a central point of an entire screen; and view direction control means for controlling a view direction of each picture element forming part of the screen of said display means, and controlling the view direction of the first image and second image so that a single user may only view either the first image or the second image but not both images at the same time.

2. A double-screen display device comprising:

displaying memory means for storing an image;

display means for displaying the image stored in said displaying memory means, said display means consisting of a screen with a smooth surface;

image writing means for writing to said displaying memory means a first image and a second image symmetrical to the first image about a central point of an entire screen; and view direction control means for controlling a view direction of each picture element forming part of the screen of said display means, and controlling the view direction of the first image and second image, said view direction control means comprises:

a first blocking unit for controlling a radiating direction of a light from a first picture element forming part of the first image and for making the light from the first picture element invisible from a first view field; and a second blocking unit for controlling a radiating direction of a light from a second picture element forming part of the second image and for making the light from the second picture element invisible from a second view field.

3. The double-screen display device according to claim 2, wherein said first view field and second view field are located opposite to each other on the screen of said display means.

4. The double-screen display device according to claim 3, wherein said first blocking unit and second blocking unit are provided for each picture element.

5. The double-screen display device according to claim 4, wherein said blocking units are holograms.

6. The double-screen display device according to claim 5, wherein adjacent holograms are separated by a light blocking unit.

7. The double-screen display device according to claim 4, wherein said first blocking unit and second blocking unit are arranged exclusively for specified vertical scanning lines on the screen of said display means.

8. The display means according to claim 7, wherein said first blocking unit and second blocking unit are alternately arranged in said vertical scanning line unit.

9. The double-screen display device according to claim 8, wherein said first blocking unit and second blocking unit are alternately arranged every other vertical scanning line.

10. The double-screen display device according to claim 8, wherein said first blocking unit and second blocking unit are alternately arranged every vertical scanning lines of a predetermined number.

11. The double-screen display device according to claim 3, wherein the screen of said display means is divided into a plurality of blocks each comprising a plurality of adjacent picture elements; and said first blocking units and second blocking units are exclusively arranged for each block.

12. The double-screen display device according to claim 3, wherein the screen of said display means is divided into a plurality of sections; and said first blocking unit and second blocking unit are exclusively arranged for each of divided sections.

13. The double-screen display device according to claim 12, wherein the screen of said display means is divided into an upper section and a lower section.

14. The double-screen display device according to claim 12, wherein the screen of said display means is divided into a right section and a left section.

15. A double-screen display device comprising:

displaying memory means for storing an image;

display means for displaying the image stored in said displaying memory means, said display means consisting of a screen with a smooth surface;

first image storage means for storing an entire first image;

second image storage means for storing an entire second image symmetric to the first image about a central point of an entire screen;

image writing means for writing a part of the first image stored in said first image storage means and the second image stored in said second image storage means to exclusive positions in said displaying memory means so that an image displayed on said display means can be written to said displaying memory means; and view direction control means for controlling a view direction of each picture element forming part of the screen of said display means, and controlling the view direction of the first image and second image so that a single user may only view either the first image or the second image but not both images at the same time.

16. The double-screen display device according to claim 15 further comprising:

image storage control means for writing only an image read by said image writing means to said first image storage means or said second image storage means.

17. A double-screen display device comprising:

displaying memory means for storing an image;

display means for displaying the image stored in said displaying memory means;

image writing means for writing to said displaying memory means a first image and a second image symmetrical to the first image about a central point of an entire screen;

view direction control means for controlling a view direction of each picture element forming part of the screen of said display means, and controlling the view direction of the first image and second image;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said displaying memory means so that the other marker also moves on the screen of said display means.

18. The double-screen display device according to claim 17, wherein said marker move control means comprises:

first marker move signal output means for calculating a display position of the first marker on the screen of said display means according to an instruction from said first marker move instructing means and outputting a signal indicating the display position;

second marker move signal output means for calculating a display position of the second marker on the screen of said display means according to an instruction from said second marker move instructing means and outputting the signal the display position;

marker move signal inverting means for receiving the signals from said first marker move signal output means and said second marker move signal output means, and calculating the display position of the second marker on the screen of said display means according to the signal output from said first marker move signal output means;

first marker display position output means for selecting and outputting an input from one of said first marker move signal output means and said marker move signal inverting means;

second marker display position output means for selecting and outputting an input from one of said second marker move signal output means and said marker move signal inverting means; and marker image writing means for writing the image of the first marker and the image of the second marker to said displaying memory means according to a first marker display position signal received from said first marker display position output means and a second marker display position signal received from said second marker display position output means.

19. The double-screen display device according to claim 18, wherein said view direction control means controls the view direction of the image of the first marker as the view direction of the first image and controls the view direction of the image of the second marker as the view direction of the second image.

20. The double-screen display device according to claim 17, wherein said first marker move instructing means or said second marker move instructing means instructs to move the first or second marker by a touching operation on the screen of said display means.

21. A double-screen display device comprising:

displaying memory means for storing an image;

display means for displaying the image stored in said displaying memory means, said display means consisting of a screen with a smooth surface;

image writing means for writing to said displaying memory means alternately a first image and a second image symmetrical to the first image about a central point of the entire screen of said display means; and view direction control means for controlling a view direction of each picture element forming part of the screen of said display means, and controlling the view directions of the first image and second image alternately displayed on the screen such that the view direction of the first image is opposite to the view direction of the second image so that a single user may only view either the first image or the second image but not both images at the same time.

22. A double-screen display device comprising:

displaying memory means for storing an image;

display means for displaying the image stored in said displaying memory means, said display means consisting of a screen with a smooth surface;

image writing means for writing to said displaying memory means alternately a first image and a second image symmetrical to the first image about a central point of the entire screen of said display means; and view direction control means for controlling a view direction of each picture element forming part of the screen of said display means, and controlling the view directions of the first image and second image alternately displayed on the screen such that the view direction of the first image is opposite to the view direction of the second image, said view direction control means comprises:

a blocking unit for switching through external control the view direction of a light from each picture element forming part of the screen of said display means; and blocking control means for controlling said blocking unit such that the first image is set in a first direction and the second image is set in a second direction opposite to the first direction.

23. The double-screen display device according to claim 22, wherein said blocking unit is liquid crystal.

24. A double-screen display device comprising:

displaying memory means for storing an image;

display means for displaying the image stored in said displaying memory means;

image writing means for writing to said displaying memory alternately a first image and a second image symmetrical to the first image about a central point of an entire screen;

view direction control means for controlling a view direction of each picture element forming part of the screen of said display means, and controlling the view directions of the first image and second image alternately displayed on the screen such that the view direction of the first image is opposite to the view direction of the second image;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said displaying memory means so that the other marker also moves on the screen of said display means.

25. The double-screen display device according to claim 24, wherein said view direction control means comprises:

a blocking unit for switching through external control the view direction of a light from each picture element forming part of the screen of said display means; and blocking control means for controlling said blocking unit such that the first image is set in a first direction and the second image is set in a second direction opposite to the first direction.

26. The double-screen display device according to claim 25, wherein said blocking unit is liquid crystal.

27. The double-screen display device according to claim 24, wherein said first marker move instructing means or said second marker move instructing means instructs to move the first or second marker by a touching operation on the screen of said display means.

28. A double-screen display device comprising:

displaying memory means for storing an image;

display means for displaying the image stored in said displaying memory means, the screen of said display means having a smooth surface;

image writing means for writing a plurality of images to said displaying memory means; and view direction control means for controlling a view direction of each picture element forming part of the screen of said display means, and individually controlling the view directions of the plurality of images so that a single user may only view a single image of the plurality of images.

29. A double-screen display device comprising:

displaying memory means for storing an image;

display means for displaying the image stored in said displaying memory means, the screen of said display means having a smooth surface;

image writing means for writing a plurality of images to said displaying memory means; and view direction control means for controlling a view direction of each picture element forming part of the screen of said display means, and individually controlling the view directions of the plurality of images, said view direction control means comprises:

a plurality of blocking units for controlling a radiating direction of a light from each picture element forming part of the screen of said display means and for individually controlling view fields of lights from the picture elements of the plurality of images.

30. The double-screen display device according to claim 29, wherein said view fields of the plurality of images are different.

31. The double-screen display device according to claim 30, wherein each of said plurality of blocking units is provided for each of the picture elements.

32. The double-screen display device according to claim 31, wherein said blocking units are holograms.

33. The double-screen display device according to claim 32, wherein adjacent holograms are separated by a light blocking unit.

34. The double-screen display device according to claim 33, wherein said plurality of blocking units are arranged exclusively for specified vertical scanning lines on the screen of said display means.

35. The double-screen display device according to claim 34, wherein said plurality of blocking units are alternately arranged in said vertical scanning lines.

36. The double-screen display device according to claim 34, wherein said plurality of blocking units are exclusively arranged every other vertical scanning line.

37. The double-screen display device according to claim 34, wherein said plurality of blocking units are exclusively arranged every vertical scanning lines of a predetermined number.

38. The double-screen display device according to claim 33, wherein the screen of said display means is divided into a plurality of blocks each comprising a plurality of adjacent picture elements; and said plurality of blocking units are exclusively arranged for each block.

39. The double-screen display device according to claim 33, wherein the screen of said display means is divided into a plurality of sections; and said plurality of blocking units are exclusively arranged for each of divided sections.

40. The double-screen display device according to claim 39, wherein the screen of said display means is divided into a plurality of vertically arranged sections.

41. The double-screen display device according to claim 39, wherein the screen of said display means is divided into a plurality of horizontally arranged sections.

42. A double-screen display device comprising:

displaying memory means for storing an image;

display means for displaying the image stored in said displaying memory means, said display means consisting of a screen with a smooth surface;

N image storage means for storing different N images;

image writing means for writing a part of N images stored in said N image storage means to exclusive positions in said image storage means so that an image displayed on said display means can be written to said image storage means; and view direction control means for controlling a view direction of each picture element forming part of the screen of said display means, and controlling the view direction of the N images so that a single user may only view one of the N images being displayed at a time.

43. The double-screen display device according to claim 42 further comprising:

control means for writing only an image read by said image writing means to at least one of said N image storage means.

44. A double-screen display device comprising:

displaying memory means for storing an image;

display means for displaying the image stored in said displaying memory means, said display means consisting of a screen with a smooth surface;

image writing means for alternately writing a plurality of images to said displaying memory means; and view direction control means for controlling a view direction of each picture element forming part of the screen of said display means, and controlling the view directions of the plurality of images alternately displayed on the screen such that one view direction is opposite to the other view direction so that a single user may only view one image of the plurality of images at a given time.

45. A double-screen display device comprising:

displaying memory means for storing an image;

display means for displaying the image stored in said displaying memory means, said display means consisting of a screen with a smooth surface;

image writing means for alternately writing a plurality of images to said displaying memory means; and view direction control means for controlling a view direction of each picture element forming part of the screen of said display means, and controlling the view directions of the plurality of images alternately displayed on the screen such that one view direction is opposite to the other view direction, said view direction control means comprises:

a blocking unit for switching through external control the view direction of a light from each picture element forming part of the screen of said display means; and blocking control means for controlling said blocking unit such that the plurality of images are set in opposite view directions.

46. The double-screen display device according to claim 45, wherein said blocking unit is liquid crystal.

47. A double-screen display device comprising:

displaying memory means for storing an image;

display means for displaying the image stored in said displaying memory means;

image writing means for alternately writing a plurality of images to said displaying memory means;

view direction control means for controlling a view direction of each picture element forming part of the screen of said display means, and controlling the view directions of the plurality of images alternately displayed on the screen such that the view direction of one image is opposite to the view direction of the other;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said image storage means so that the other marker also moves on the screen of said display means.

48. The double-screen display device according to claim 47, wherein said first marker move instructing means or said second marker move instructing means instructs to move the first or second marker by a touch on the screen of said display means.

49. A double-screen display device comprising:

displaying memory means for storing an image;

display means for displaying the image stored in said displaying memory means, said display means having a screen with an entirely smooth surface;

image writing means for writing to said displaying memory means a first image, a second image symmetrical to the first image about a central point of an entire screen, and information about the first image; and view direction control means for controlling a view direction of each picture element forming part of the screen of said display means, controlling the view directions of the first image and second image displayed on the screen, and controlling the view direction of the information about the first image such that the information can be displayed in the same view direction of the first image so that a single user may only view either the first image and the information about the first image or the second image but not both images at the same time.

50. The double-screen display device according to claim 49, wherein said information about the first image is text data.

51. A double-screen display device comprising:

image storage means for storing an image;

display means for displaying the image stored in said displaying memory means;

image writing means for writing to said displaying memory means a first image, a second image symmetrical to the first image about a central point of an entire screen, and information about the first image;

view direction control means for controlling a view direction of each picture element forming part of the screen of said display means, controlling the view directions of the first image and second image displayed on the screen, and controlling the view direction of the information about the first image such that the information can be displayed in the same view direction of the first image;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said image storage means so that the other marker also moves on the screen of said display means.

52. The double-screen display device according to claim 51, wherein said information about the first image is text data.

53. A double-screen display device comprising:

displaying memory means for storing an image;

display means for displaying the image stored in said displaying memory means, said display means having a screen with an entirely smooth surface;

image writing means for writing to said displaying memory means alternately a first image, information about the first image, and a second image symmetrical to the first image about a central point of an entire screen; and view direction control means for controlling a view direction of each picture element forming part of the screen of said display means, and controlling the view directions of the first image and the information about the first image and second image, alternately displayed on the screen, such that the view direction of the first image and the information about the first image is opposite to the view direction of the second image so that a single user may only view either the first image and the information about the first image or the second image but not both images at the same time.

54. The double-screen display device according to claim 53, wherein said information about the first image is text data.

55. A double-screen display device comprising:

displaying memory means for storing an image;

display means for displaying the image stored in said displaying memory means;

image writing means for writing to said displaying memory means alternately a first image, information about the first image, and a second image symmetrical to the first image about a central point of an entire screen;

view direction control means for controlling a view direction of each picture element forming part of the screen of said display means, and controlling the view directions of the first image and the information about the first image and second image, alternately displayed on the screen, such that the view direction of the first image and the information about the first image is opposite to the view direction of the second image;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said image storage means so that the other marker also moves on the screen of said display means.

56. The double-screen display device according to claim 55, wherein said information about the first image is text data.

57. The double-screen display device according to claim 55, wherein said display means is a desktop unit.

58. The display means according to claim 55, wherein said display means is mounted onto a display unit of a handy terminal device.

59. A double-screen display device comprising:

a storage device storing a removable storage medium containing an image file; displaying memory means for storing an image;

display means for displaying the image stored in said displaying memory means, said display means consisting of a screen wit a smooth surface;

image writing means for reading a first image stored in the image file and writing to said displaying memory means the first image and a second image symmetrical to the first image about a central point of the entire screen of said display means; and view direction control means for controlling a view direction of each picture element forming part of the screen of said display means, and controlling the view direction of the first image and second image so that a single user may only view either the first image or the second image but not both images at the same time.

60. The double-screen display device according to claim 59, wherein said display means is a desktop unit.

61. The display means according to claim 59, wherein said display means is mounted onto a display unit of a handy terminal device.

62. A double-screen display device comprising:

a storage device storing a removable storage medium containing an image file;

displaying memory means for storing an image;

display means for displaying the image stored in said displaying memory means, said display means consisting of a screen with a smooth surface;

first image storage means for storing an entire first image;

second image storage means for storing an entire second image symmetric to the first image about a central point of the entire screen of said display means;

first image writing means for reading the first image from the image file, writing the first image to said first image storage means, generating the second image from the first image, and writing the second image to said second image storage means;

second image writing means for writing a part of the first image stored in said first image storage means and the second image stored in said second image storage means to exclusive positions in said image storage means so that an image displayed on said display means can be written to said image storage means; and view direction control means for controlling a view direction of each picture element forming part of the screen of said display means, and controlling the view direction of the first image and second image so that a single user may only view either the first image or the second image but not both images at the same time.

63. The double-screen display device according to claim 62, wherein said display means is a desktop unit.

64. The display means according to claim 62, wherein said display means is mounted onto a display unit of a handy terminal device.

65. A double-screen display device comprising:

a storage device storing a removable storage medium containing an image file;

displaying memory means for storing an image;

display means for displaying the image stored in said displaying memory means;

image writing means for reading a first image stored in the image file and writing to said image storage means the first image and a second image symmetrical to the first image about a central point of an entire screen;

view direction control means for controlling a view direction of each picture element forming part of the screen of said display means, and controlling the view direction of the first image and second image;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said displaying memory means so that the other marker also moves on the screen of said display means.

66. The double-screen display device according to claim 65, wherein said display means is a desktop unit.

67. The display means according to claim 65, wherein said display means is mounted onto a display unit of a handy terminal device.

68. A double-screen display device comprising:

a storage device storing a removable storage medium containing an image file;

displaying memory means for storing an image;

display means for displaying the image stored in said displaying memory means, said display means consisting of a screen with a smooth surface;

image writing means for reading a first image from the image file, generating a second image symmetrical to the first image about a central point of an entire screen, and alternately writing to said image storage means the first image and second image; and view direction control means for controlling a view direction of each picture element forming part of the screen of said display means, and controlling the view directions of the first image and second image alternately displayed on the screen such that the view direction of the first image is opposite to the view direction of the second image so that a single user may only view either the first image or the second image but not both images at the same time.

69. The double-screen display device according to claim 68, wherein said display means is a desktop unit.

70. The display means according to claim 68, wherein said display means is mounted onto a display unit of a handy terminal device.

71. A double-screen display device comprising:

a storage device storing a removable storage medium containing an image file;

displaying memory means for storing an image;

display means for displaying the image stored in said displaying memory means;

image writing means for reading a first image from the image file, generating a second image symmetrical to the first image about a central point of an entire screen, and alternately writing to said displaying memory means the first image and second image;

view direction control means for controlling a view direction of each picture element forming part of the screen of said display means, and controlling the view directions of the first image and second image alternately displayed on the screen such that the view direction of the first image is opposite to the view direction of the second image;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said displaying memory means so that the other marker also moves on the screen of said display means.

72. The double-screen display device according to claim 71, wherein said display means is a desktop unit.

73. The display means according to claim 71, wherein said display means is mounted onto a display unit of a handy terminal device.

74. A double-screen display device comprising:

a storage device storing a removable storage medium storing an image file;

displaying memory means for storing an image;

display means for displaying the image stored in said displaying memory means, said display means consisting of a screen with a smooth surface;

image writing means for reading a first image stored in the image file, and writing to said displaying memory means the first image and a second image symmetrical to the first image about a central point of the entire screen of said display means; and view direction control means for controlling a view direction of each picture element forming part of the screen of said display means, controlling the view directions of the first image and second image displayed on the screen, and controlling a view direction of information about the first image to match the view direction of the first image so that a single user may only view either the first image and the information about the first image or the second image but not both images at the same time.

75. A double-screen display device comprising:

a storage device storing a removable storage medium containing an image file;

displaying memory means for storing an image;

image writing means for reading a first image stored in the image file, and writing to said displaying memory means the first image and a second image symmetrical to the first image about a central point of an entire screen;

display means for displaying the image stored in said displaying memory means;

view direction control means for controlling a view direction of each picture element forming part of the screen of said display means, controlling the view directions of the first image and second image displayed on the screen, and controlling view direction of information about the first image to match the view direction of the first image;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said displaying memory means so that the other marker also moves on the screen of said display means.

76. A double-screen display device comprising:

a storage device storing a removable storage medium containing an image file;

displaying memory means for storing an image;

display means for displaying the image stored in said displaying memory means, said display means consisting of a screen with a smooth surface;

image writing means for reading a first image stored in the image file, and alternately writing to said displaying memory means the first image and a second image symmetrical to the first image about a central point of the entire screen of said display means; and view direction control means for controlling a view direction of each picture element forming part of the screen of said display means, and controlling the view directions of the first image and information about the first image to be opposite to the view direction of the second image alternately displayed on the screen so that a single user may only view either the first image and the information about the first image or the second image but not both images at the same time.

77. A double-screen display device comprising:

a storage device storing a removable storage medium containing an image file;

displaying memory means for storing an image;

display means for displaying the image stored in said displaying memory means;

image writing means for reading a first image stored in the image file, and alternately writing to said displaying memory means the first image and a second image symmetrical to the first image about a central point of an entire screen;

view direction control means for controlling a view direction of each picture element forming part of the screen of said display means, and controlling the view directions of the first image and information about the first image to be opposite to the view direction of the second image alternately displayed on the screen;

first marker move instructing means for instructing to move a first marker displayed on the screen of said display means;

second marker move instructing means for instructing to move a second marker displayed on the screen of said display means; and marker move control means for modifying, at an instruction from one of said first marker move instructing means and second marker move instructing means, a write position of the image of said first or second marker in said displaying memory means so that the other marker also moves on the screen of said display means.

78. A double-screen display method comprising the steps of:

storing an image in a display memory means;

displaying the image stored in said displaying memory means using a display means having a screen with an entirely smooth surface;

writing in said storing step a first image and a second image symmetrical to the first image about a central point of an entire screen; and controlling a view direction of each picture element forming part of a screen of said display means, and controlling the view direction of the first image and second image so that a single user may only view either the first image or the second image but not both images at the same time.

79. A double-screen display method comprising the steps of:

storing an image in a displaying memory means;

displaying the image stored in said displaying memory means by a display means consisting of a screen with a smooth surface;

storing an entire first image in a first image storage means;

storing an entire second image symmetric to the first image about a central point of an entire screen in a second image storage means;

writing a part of the first image stored in said first image storage means and the second image stored in said second image storage means to exclusive positions in said displaying memory means so that an image displayed on said display means can be written to said displaying memory means; and controlling a view direction of each picture element forming part of the screen of said display means, and controlling the view direction of the first image and second image so that a single user may only view either the first image or the second image but not both images at the same time.

* * * * *